US011047321B2

(12) United States Patent
Dudar

(10) Patent No.: US 11,047,321 B2
(45) Date of Patent: Jun. 29, 2021

(54) SYSTEMS AND METHODS FOR FUEL VAPOR STORAGE CANISTER WORKING CAPACITY DIAGNOSTICS

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/212,409

(22) Filed: Dec. 6, 2018

(65) Prior Publication Data

US 2020/0182174 A1 Jun. 11, 2020

(51) Int. Cl.
*F02M 25/08* (2006.01)
*F02D 41/00* (2006.01)

(52) U.S. Cl.
CPC ..... *F02D 41/0045* (2013.01); *F02D 41/004* (2013.01); *F02M 25/089* (2013.01); *F02M 25/0854* (2013.01)

(58) Field of Classification Search
CPC ..... F02D 41/0045; F02D 41/004; F02D 2041/224; F02D 2041/225; F02M 25/0854; F02M 25/089; F02M 25/0809; F02M 25/0818; F02M 25/0836
USPC ..... 123/516, 518, 519, 520; 701/107; 73/114.39
See application file for complete search history.

(56) References Cited

U.S. PATENT DOCUMENTS

| | | | | |
|---|---|---|---|---|
| 6,478,849 | B1 * | 11/2002 | Taylor | B01D 53/04 95/106 |
| 8,770,175 | B2 * | 7/2014 | Kitamura | F02M 25/089 123/520 |
| 9,284,924 | B2 * | 3/2016 | Dudar | F02D 41/221 |
| 9,341,147 | B2 * | 5/2016 | Jentz | F02M 25/0809 |
| 9,512,791 | B1 * | 12/2016 | Dudar | F02M 25/089 |
| 9,790,898 | B2 | 10/2017 | Dudar | |
| 10,190,934 | B2 * | 1/2019 | Dudar | G01M 3/025 |
| 2014/0324284 | A1 | 10/2014 | Glinsky et al. | |
| 2015/0090233 | A1 | 4/2015 | Dudar et al. | |
| 2016/0209292 | A1 * | 7/2016 | Dudar | B60K 15/03 |
| 2016/0319775 | A1 * | 11/2016 | Dudar | F02M 25/0854 |
| 2016/0341156 | A1 | 11/2016 | Yang et al. | |
| 2017/0363055 | A1 * | 12/2017 | Dudar | F02D 41/22 |

* cited by examiner

*Primary Examiner* — Gonzalo Laguarda
(74) *Attorney, Agent, or Firm* — Geoffrey Brumbaugh; McCoy Russell LLP

(57) ABSTRACT

Methods and systems are provided for assessing a working capacity of a fuel vapor storage canister positioned in an evaporative emissions system configured to capture and store fuel vapors from a fuel system. In one example, a method comprises, in response to fuel vapor being adsorbed by, or desorbed from, the fuel vapor canister, sealing the evaporative emissions system and indicating degradation of the fuel vapor canister in response to a monitored pressure change in the evaporative emissions system less than a threshold pressure change. In this way, working capacity of the fuel vapor storage canister is inferred, which may allow for a reduction in undesired evaporative emissions to atmosphere.

12 Claims, 7 Drawing Sheets

600

Purge requested?
Yes
No
605
Conditions met for purging?
Yes
No
610
Conditions met for capacity diagnostic?
Yes
No
615
CVV status
Open
Closed
620
FTIV status
Open
Closed
625
CPV status
Open
Closed
630
FTPT1
+
Atm.
-
636
635
FTPT2
+
Atm.
640
Canister degraded ?
yes
no
645
time
t0
t1
t2
t3
t4
t5

SYSTEMS AND METHODS FOR FUEL VAPOR STORAGE CANISTER WORKING CAPACITY DIAGNOSTICS

FIELD

The present description relates generally to methods and systems for inferring a working capacity of a fuel vapor storage canister configured to adsorb fuel vapors from a vehicle fuel system.

BACKGROUND/SUMMARY

Vehicles with an internal combustion engine may be fitted with fuel vapor recovery systems, also referred to as evaporative emissions control systems, wherein vaporized hydrocarbons (HCs) released from a fuel tank are captured and stored in a fuel vapor canister containing a quantity of fuel-adsorbing material such as activated charcoal. Eventually, the fuel vapor canister may become filled with an amount of fuel vapor. The fuel canister may be cleared of fuel vapor by way of a purging operation. A fuel vapor purging operation may include opening a canister purge valve to introduce the fuel vapor into the cylinder(s) of the internal combustion engine for combustion so that fuel economy may be maintained and fuel vapor emissions may be reduced.

Activated charcoal has been found to be a suitable fuel vapor adsorbing material to be used in such a canister device because of its extremely porous structure and very large surface area to weight ratio. However, this porous structure can lose some or all of its adsorption efficiency when coated with liquid fuel or water, or other contaminants such as dust, particulate matter, etc. Accordingly, it may be desirable to periodically assess working capacity of such a canister, to infer whether the canister is functioning as desired or expected. In this way, release of undesired evaporative emissions to atmosphere may be reduced or avoided, as compared to a situation where working capacity of the canister is not assessed.

Towards this end, United State Patent Application No. US20140324284A1 discloses the use of one or more sensors positioned within a fuel vapor storage canister which may be used to measure an interior temperature of the canister and which may provide sensory output from the one or more sensors to a control module. Based on a temperature change of the fuel vapor storage canister in response to refueling or purging events, a working capacity of the canister is inferred. However, the inventors have herein recognized potential issues with such a method. In one example, installing temperature sensor(s) in fuel vapor storage canisters may be costly and cumbersome. As another example, in the event that liquid fuel or water contaminates the adsorbent material (e.g. activated charcoal), any temperature sensor positioned in the interior of the canister may too become degraded from the liquid fuel or water, thus rendering a working capacity diagnostic that relies on such temperature sensor(s) ineffective. Still further, installation of temperature sensor(s) in a canister may present opportunity for sources of undesired evaporative emissions in the canister, in situations where holes are drilled into the canister in order to install the temperature sensor(s). Thus, a diagnostic for working capacity of such a fuel vapor storage canister that does not rely on temperature sensor(s), is desirable.

The inventors have herein recognized the above-mentioned issues, and have developed systems and methods to at least partially address them. In one example, a method comprises in response to fuel vapors being adsorbed by, or desorbed from, a fuel vapor canister positioned in an evaporative emissions system of a vehicle, the fuel vapor canister capturing/storing fuel tank fuel vapors, sealing the evaporative emissions system and indicating degradation of the fuel vapor canister in response to a monitored pressure change in the evaporative emissions system less than a threshold pressure change. In this way, a working capacity of the fuel vapor canister may be inferred without relying on a direct means of monitoring canister loading. Accordingly, release of undesired evaporative emissions to atmosphere may be reduced, and working capacity may be inferred under circumstances where other direct means of monitoring canister loading may be compromised.

In one example of the method, sealing the evaporative emissions system may include sealing the evaporative emissions system from an engine of the vehicle, the fuel tank, and from atmosphere. In this way, issues related to fuel vaporization may be avoided in conducting the diagnostic for working capacity, which may increase robustness of the results of the diagnostic.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 2:
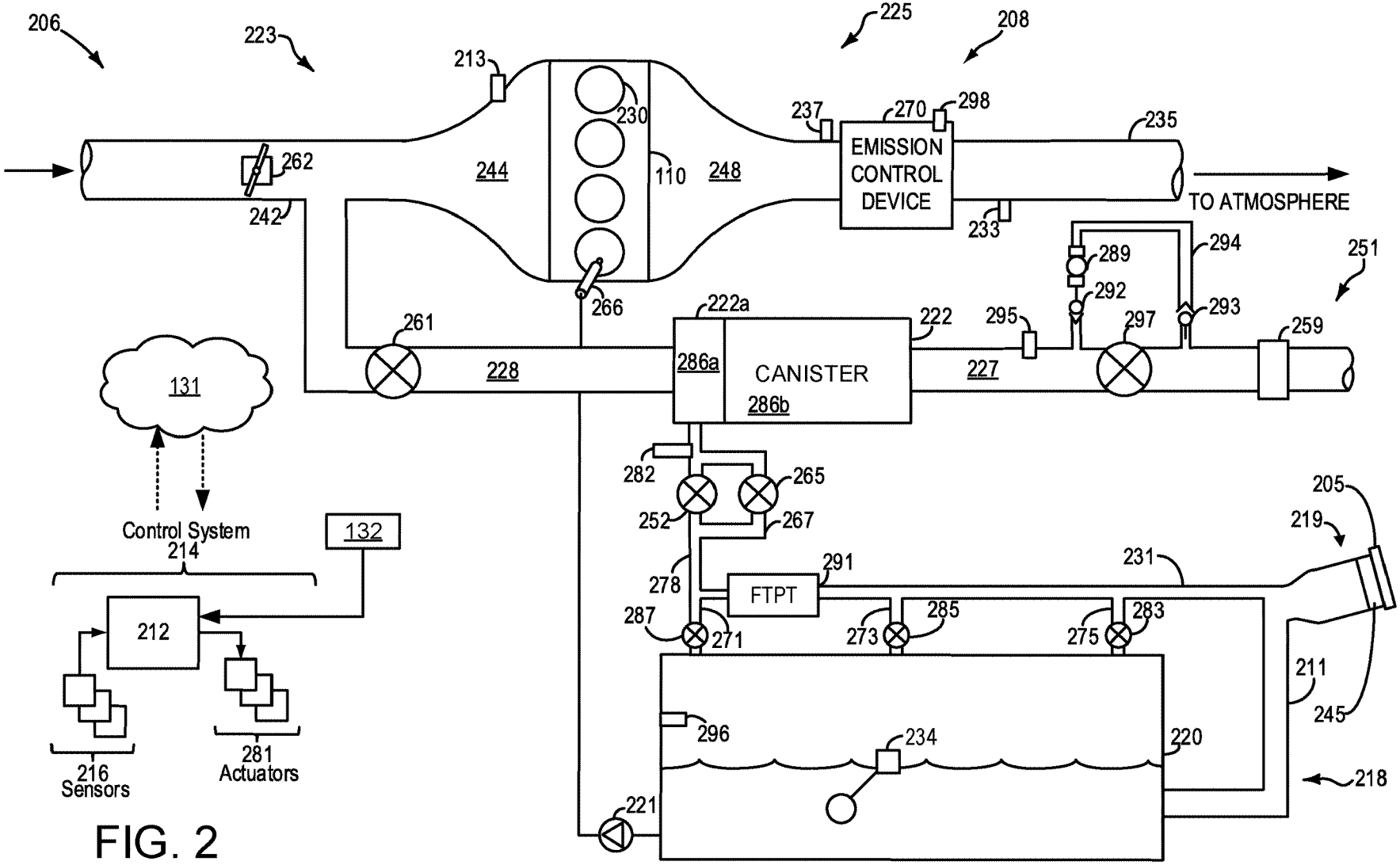
FIG. 2 schematically shows an example vehicle system with a fuel system and an evaporative emissions system.
Figure 3:
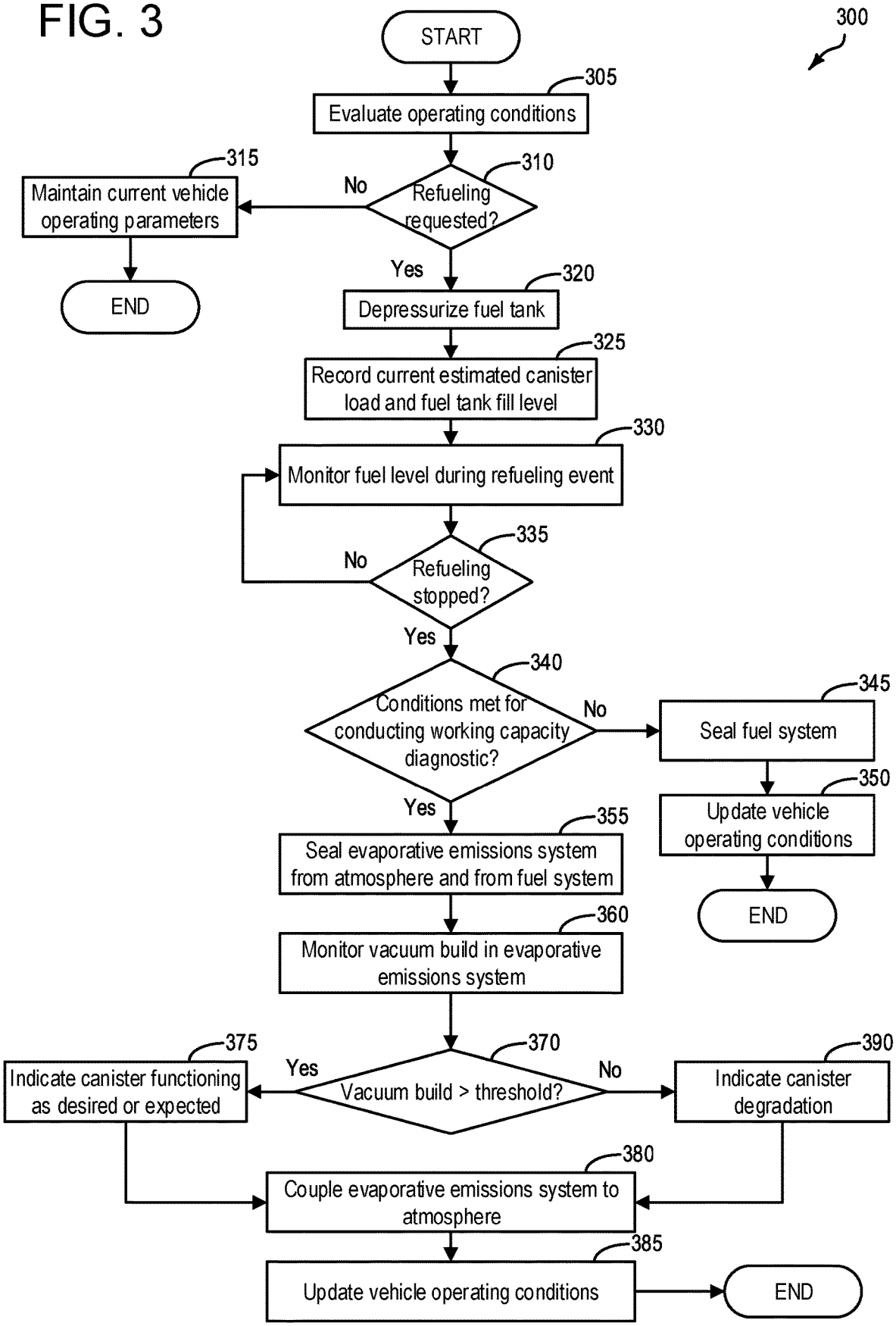
FIG. 3 depicts a high-level example method for conducting a canister working capacity diagnostic subsequent to a refueling event.
Figure 4:
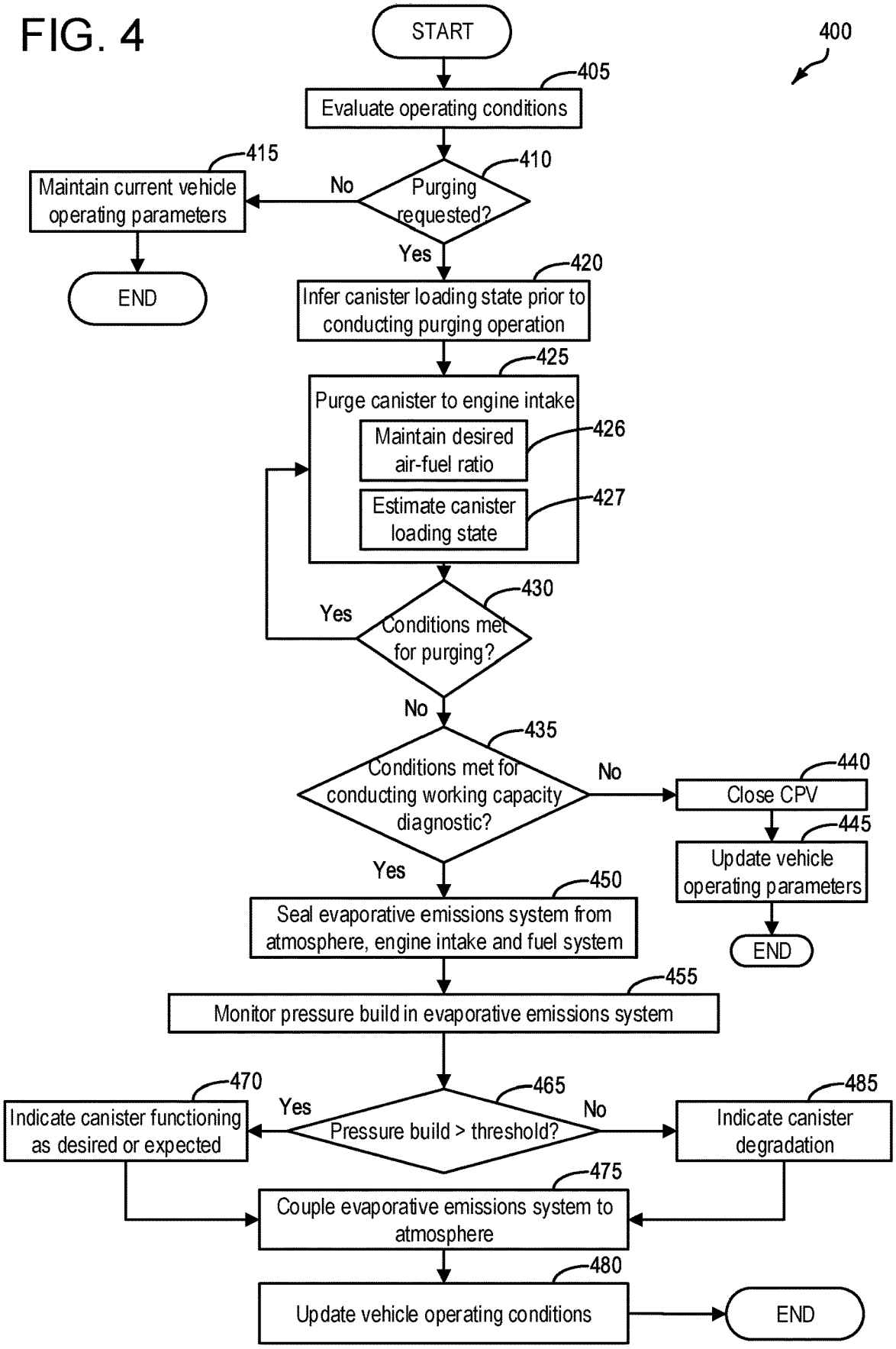
FIG. 4 depicts a high-level example method for conducting a canister working capacity diagnostic subsequent to a canister purging event.
Figure 5:
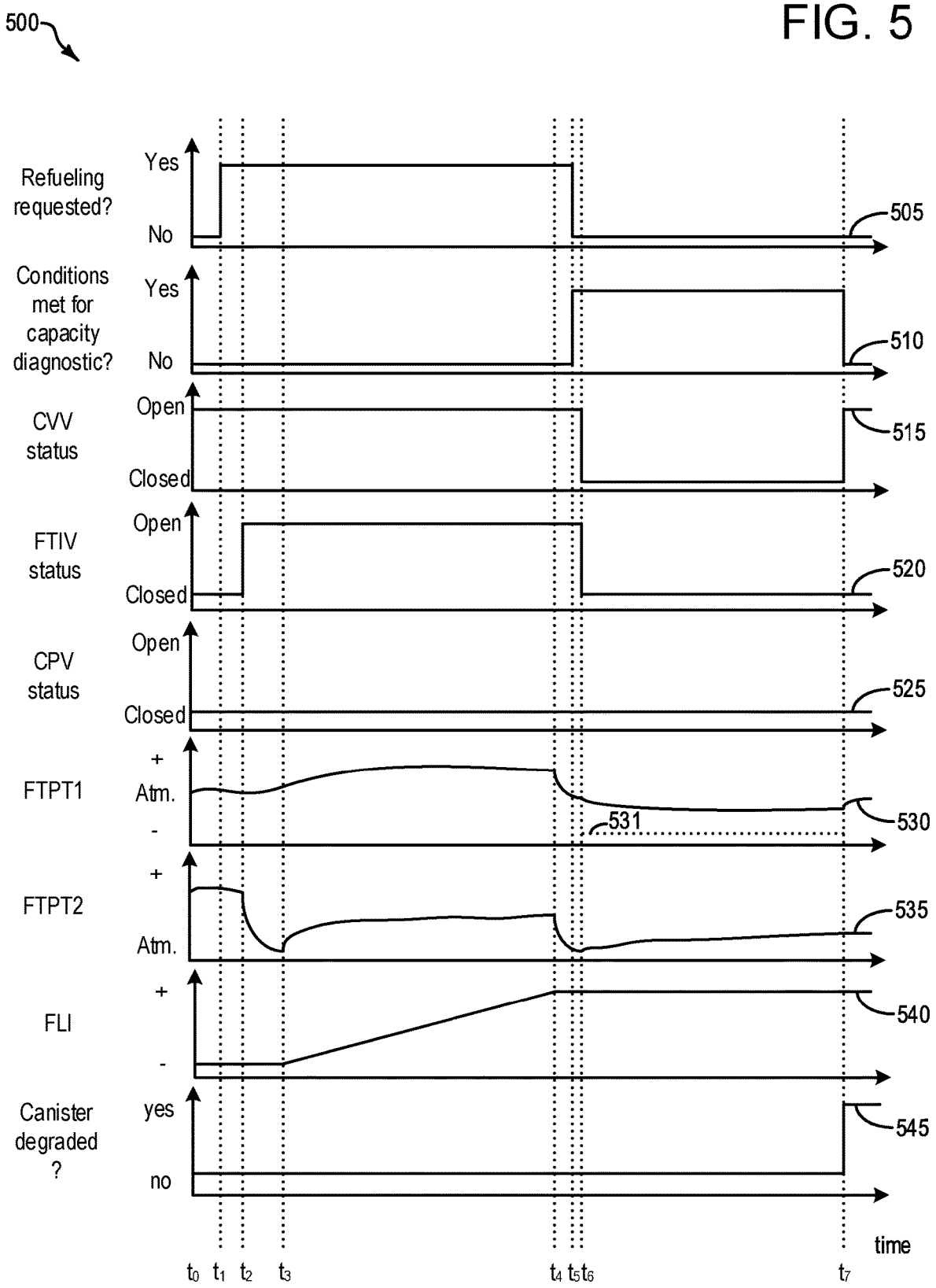
FIG. 5 depicts an example timeline for conducting a canister working capacity diagnostic according to the method of FIG. 3.
Figure 6:
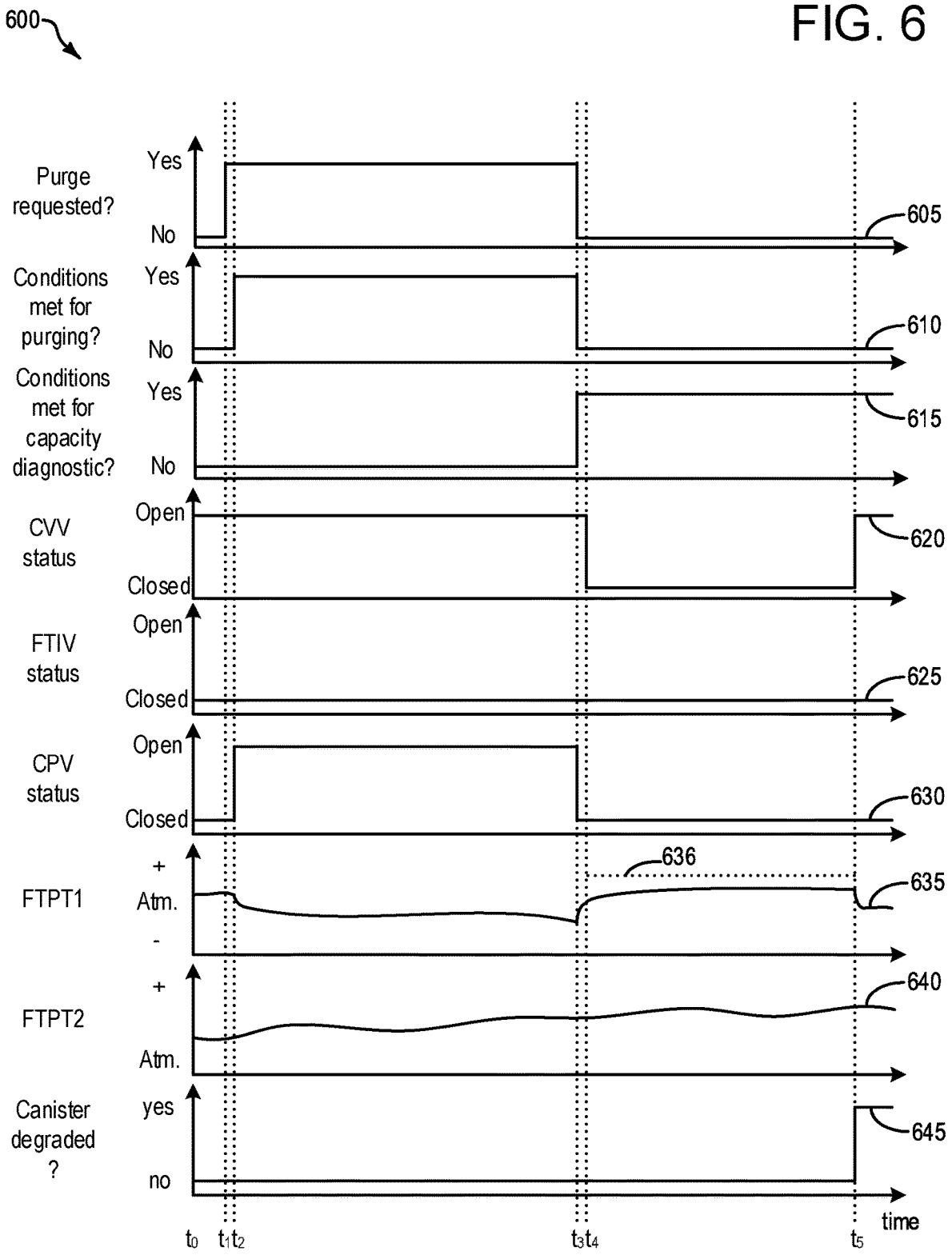
FIG. 6 depicts an example timeline for conducting a canister working capacity diagnostic according to the method of FIG. 4.
Figure 7:
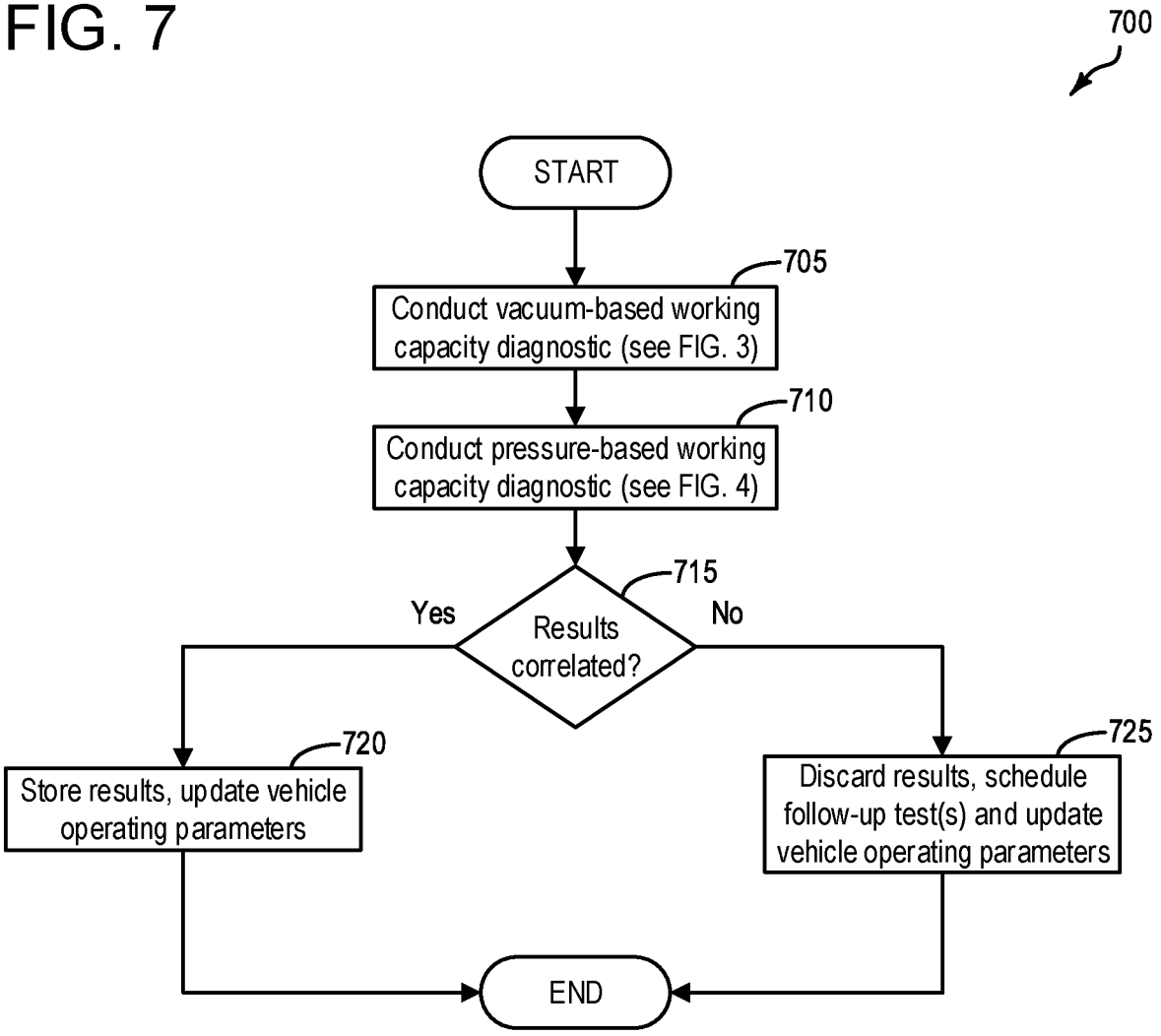
FIG. 7 depicts a high-level example method for relying on the working capacity diagnostic depicted at FIG. 4 as a rationality check for the working capacity diagnostic depicted at FIG. 3.

The following description relates to systems and methods for inferring a working capacity of a fuel vapor storage canister configured to capture and store fuel vapors from a fuel tank of a vehicle. Such canisters may be included in hybrid vehicles with limited engine run-time, such as the hybrid vehicle of FIG. 1. The canister may be positioned in an evaporative emissions system that is selectively fluidically coupled via valves to atmosphere, the fuel tank, and to engine intake, as depicted at FIG. 2. Fuel vapor adsorption by a fuel vapor canister is an exothermic process that results in a heat gain at the fuel vapor canister, whereas fuel vapor desorption is an endothermic process that results in a cooling of the canister. Accordingly, it is herein recognized that, subsequent to a refueling event where fuel vapor is adsorbed by the canister, for example within a predetermined time frame (e.g. within 1 minute or less) after refueling has stopped, if the evaporative emissions system is sealed, a vacuum may build as the canister cools. The extent of the vacuum build may be used to infer canister working capacity, as depicted by the method of FIG. 3. It is further recognized that, subsequent to a purging event of the canister where fuel vapor is desorbed from the canister, if the evaporative emissions system is sealed, pressure may build as the canister temp rises. The extent of the pressure build may be used to infer working capacity, as depicted by the method of FIG. 4. An example timeline for conducting the methodology of FIG. 3 is depicted at FIG. 5, and an example timeline for conducting the methodology of FIG. 4 is depicted at FIG. 6. In some examples, the methodology of FIG. 4 may be used as a rationality check for results obtained from the methodology of FIG. 3. In such an example, high confidence results may be obtained by comparing the results obtained by the methods of FIG. 3 and FIG. 4, as detailed by the methodology of FIG. 7.

Figure 1:
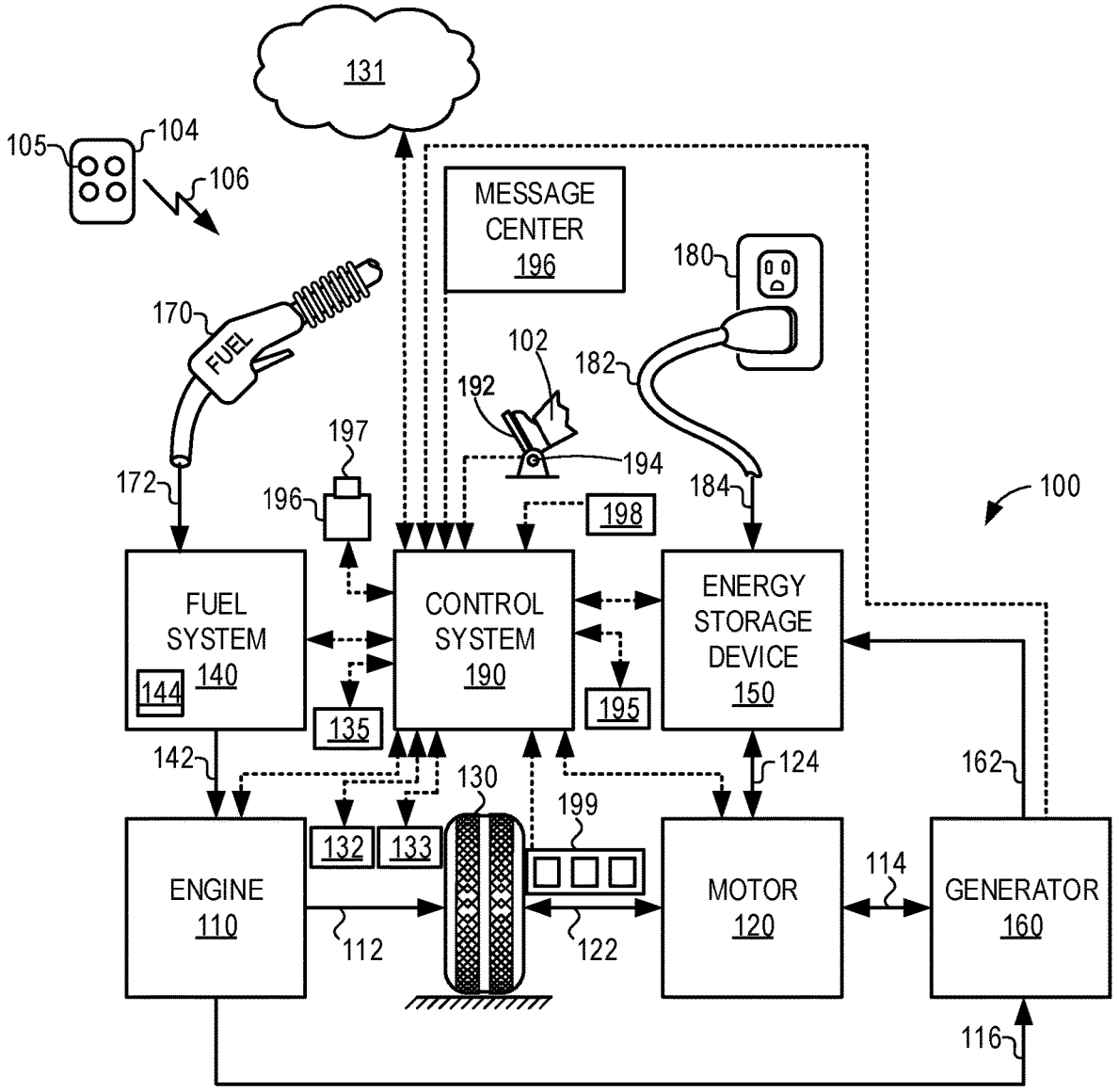
FIG. 1 shows a high-level block diagram illustrating an example vehicle system.

Turning now to the figures, FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV). Vehicle propulsion system 100 may utilize a variety of different operational modes depending on operating conditions encountered by the vehicle propulsion system. Some of these modes may enable engine 110 to be maintained in an off state (i.e., set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some examples. However, in other examples, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some examples, motor 120 may propel the vehicle via a first set of drive wheels and engine 110 may propel the vehicle via a second set of drive wheels.

In other examples, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160 as indicated by arrow 116, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some examples, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal. Furthermore, in some examples control system 190 may be in communication with a remote engine start receiver 195 (or transceiver) that receives wireless signals 106 from a key fob 104 having a remote start button 105. In other examples (not shown), a remote engine start may be initiated via a cellular telephone, or smartphone based system where a user's cellular telephone sends data to a server and the server communicates with the vehicle to start the engine.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (PHEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other examples, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some examples, fuel tank 144 may be configured to store the fuel received from fuel dispensing device 170 until it is supplied to engine 110 for combustion. In some examples, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication via a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, in response to the vehicle operator actuating refueling button 197, a fuel tank in the vehicle may be depressurized so that refueling may be performed.

In some examples, vehicle propulsion system 100 may include one or more onboard cameras 135. Onboard cameras 135 may communicate photos and/or video images to control system 190, for example. Onboard cameras may in some examples be utilized to record images within a predetermined radius of the vehicle, for example.

Control system 190 may be communicatively coupled to other vehicles or infrastructures using appropriate communications technology, as is known in the art. For example, control system 190 may be coupled to other vehicles or infrastructures via a wireless network 131, which may comprise Wi-Fi, Bluetooth, a type of cellular service, a wireless data transfer protocol, and so on. Control system 190 may broadcast (and receive) information regarding vehicle data, vehicle diagnostics, traffic conditions, vehicle location information, vehicle operating procedures, etc., via vehicle-to-vehicle (V2V), vehicle-to-infrastructure-to-vehicle (V2I2V), and/or vehicle-to-infrastructure (V2I or V2X) technology. The communication and the information exchanged between vehicles can be either direct between vehicles, or can be multi-hop. In some examples, longer range communications (e.g. WiMax) may be used in place of, or in conjunction with, V2V, or V2I2V, to extend the coverage area by a few miles. In still other examples, vehicle control system 190 may be communicatively coupled to other vehicles or infrastructures via a wireless network 131 and the internet (e.g. cloud), as is commonly known in the art.

Vehicle system 100 may also include an on-board navigation system 132 (for example, a Global Positioning System) that an operator of the vehicle may interact with. The navigation system 132 may include one or more location sensors for assisting in estimating vehicle speed, vehicle altitude, vehicle position/location, etc. This information may be used to infer engine operating parameters, such as local barometric pressure. As discussed above, control system 190 may further be configured to receive information via the internet or other communication networks. Information received from the GPS may be cross-referenced to information available via the internet to determine local weather conditions, local vehicle regulations, etc. In some examples, vehicle system 100 may include lasers, radar, sonar, acoustic sensors 133, which may enable vehicle location, traffic information, etc., to be collected via the vehicle.

FIG. 2 shows a schematic depiction of a vehicle system 206. It may be understood that vehicle system 206 may comprise the same vehicle system as vehicle system 100 depicted at FIG. 1. The vehicle system 206 includes an engine system 208 coupled to an emissions control system (also referred to herein as an evaporative emissions system, or evap system) 251 and a fuel system 218. It may be understood that fuel system 218 may comprise the same fuel system as fuel system 140 depicted at FIG. 1. Emission control system 251 includes a fuel vapor container or canister 222 which may be used to capture and store fuel vapors. In some examples, vehicle system 206 may be a hybrid electric vehicle system. However, it may be understood that the description herein may refer to a non-hybrid vehicle without departing from the scope of the present disclosure.

The engine system 208 may include an engine 110 having a plurality of cylinders 230. The engine 110 includes an engine air intake 223 and an engine exhaust 225. The engine air intake 223 includes a throttle 262 in fluidic communication with engine intake manifold 244 via an intake passage 242. Further, engine air intake 223 may include an air box and filter (not shown) positioned upstream of throttle 262. The engine exhaust system 225 includes an exhaust manifold 248 leading to an exhaust passage 235 that routes exhaust gas to the atmosphere. The engine exhaust system 225 may include one or more emissions control devices such as exhaust catalyst 270, which may be mounted in a close-coupled position in the exhaust. In some examples, an electric heater 298 may be coupled to the exhaust catalyst, and utilized to heat the exhaust catalyst to or beyond a predetermined temperature (e.g. light-off temperature). The one or more emission control devices may include a three-way catalyst, lean NOx trap, diesel particulate filter, oxidation catalyst, etc. It will be appreciated that other components may be included in the engine such as a variety of valves and sensors. For example, a barometric pressure sensor 213 may be included in the engine intake. In one example, barometric pressure sensor 213 may be a manifold air pressure (MAP) sensor and may be coupled to the engine intake downstream of throttle 262. Barometric pressure sensor 213 may rely on part throttle or full or wide open throttle conditions, e.g., when an opening amount of throttle 262 is greater than a threshold, in order accurately determine BP.

Fuel system 218 may include a fuel tank 220 coupled to a fuel pump system 221. It may be understood that fuel tank 220 may comprise the same fuel tank as fuel tank 144 depicted above at FIG. 1. In an example, fuel tank 220 comprises a steel fuel tank. In some examples, the fuel system may include a fuel tank temperature sensor 296 for measuring or inferring a fuel temperature. The fuel pump system 221 may include one or more pumps for pressurizing fuel delivered to the injectors of engine 110, such as the example injector 266 shown. While only a single injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to an evaporative emissions control system (referred to herein as evaporative emissions system) 251 which includes a fuel vapor canister 222 via conduit 278, before being purged to the engine intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves may be positioned in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a fuel filler system 219. In some examples, fuel filler system may include a fuel cap 205 for sealing off the fuel filler system from the atmosphere. Refueling system 219 is coupled to fuel tank 220 via a fuel filler pipe or neck 211.

Further, refueling system 219 may include refueling lock 245. In some examples, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some examples, refueling lock 245 may be a filler pipe valve located at a mouth of fuel filler pipe 211. In such examples, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some examples, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In examples where refueling lock 245 is locked using an electrical mechanism, refueling lock 245 may be unlocked by commands from controller 212, for example, when a fuel tank pressure decreases below a pressure threshold (e.g. within a 5% difference or less of atmospheric pressure). In examples where refueling lock 245 is locked using a mechanical mechanism, refueling lock 245 may be unlocked via a pressure gradient, for example, when a fuel tank pressure decreases to atmospheric pressure.

Emissions control system 251 may include one or more emissions control devices, such as one or more fuel vapor canisters 222, as discussed. The fuel vapor canisters may be filled with an appropriate adsorbent **286*b*, such that the canisters are configured to temporarily trap fuel vapors (including vaporized hydrocarbons) during fuel tank refilling operations and during diagnostic routines, as will be discussed in detail below. In one example, the adsorbent 286*b* used is activated charcoal. Emissions control system 251 may further include a canister ventilation path or vent line 227 which may route gases out of the canister 222 to the atmosphere when storing, or trapping, fuel vapors from fuel system 218**.

Canister 222 may include a buffer **222*a* (or buffer region), each of the canister and the buffer comprising the adsorbent. As shown, the volume of buffer 222*a* may be smaller than (e.g., a fraction of) the volume of canister 222. The adsorbent 286*a* in the buffer 222*a* may be same as, or different from, the adsorbent in the canister (e.g., both may include charcoal). Buffer 222*a* may be positioned within canister 222** such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine.

Vent line 227 may also allow fresh air to be drawn into canister 222 when purging stored fuel vapors from fuel system 218 to engine intake 223 via purge line 228 and canister purge valve 261. For example, purge valve 261 may be normally closed but may be opened during certain conditions so that vacuum from engine intake manifold 244 is provided to the fuel vapor canister for purging. In some examples, vent line 227 may include an air filter 259 disposed therein upstream of a canister 222.

In some examples, the flow of air and vapors between canister 222 and the atmosphere may be regulated by a canister vent valve 297 coupled within vent line 227. When included, the canister vent valve 297 may be a normally open valve, so that fuel tank isolation valve 252 (FTIV) may control venting of fuel tank 220 with the atmosphere. FTIV 252 may be positioned between the fuel tank and the fuel vapor canister 222 within conduit 278. FTIV 252 may be a normally closed valve, that when opened, allows for the venting of fuel vapors from fuel tank 220 to fuel vapor canister 222. Fuel vapors may then be vented to atmosphere, or purged to engine intake system 223 via canister purge valve 261.

Furthermore, a tank pressure control valve (TPC) 265 may be positioned in conduit 267. TPC 265 may be used to control venting of fuel tank 220 during vehicle operating conditions in order to regulate fuel tank pressure.

In some examples, vent line 227 may include a hydrocarbon sensor 295. Such a hydrocarbon sensor may be configured to monitor for a presence of hydrocarbons in the vent line, and if detected, mitigating actions may be undertaken to prevent undesired bleed-emissions from reaching atmosphere. In some examples, output from hydrocarbon sensor 295 may be used to infer potential degradation of the fuel vapor canister, which may result in one or more diagnostics being conducted to indicate whether the canister has become degraded as will be discussed in further detail below.

Fuel system 218 may be operated by controller 212 in a plurality of modes by selective adjustment of the various valves and solenoids. It may be understood that control system 214 may comprise the same control system as control system 190 depicted above at FIG. 1. For example, the fuel system may be operated in a fuel vapor storage mode (e.g., during a fuel tank refueling operation and with the engine not combusting air and fuel), wherein the controller 212 may open isolation valve 252 (when included) while closing canister purge valve (CPV) 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may open isolation valve 252, while maintaining canister purge valve 261 closed, to depressurize the fuel tank before allowing enabling fuel to be added therein. As such, isolation valve 252 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine combusting air and fuel), wherein the controller 212 may open canister purge valve 261 while closing or maintaining closed isolation valve 252, and while closing or maintaining closed TPC valve 265. Herein, vacuum generated by the intake manifold of the operating engine may be used to draw fresh air through vent 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold (e.g. 5% loaded or less). In some examples, purging may include additionally commanding open the FTIV (or TPC valve), such that fuel vapors from the fuel tank may additionally be drawn into the engine for combustion.

Control system 214 is shown receiving information from a plurality of sensors 216 (various examples of which are described herein) and sending control signals to a plurality of actuators 281 (various examples of which are described herein). As one example, sensors 216 may include exhaust gas sensor 237 (e.g. heated exhaust gas oxygen sensor or HEGO) located upstream of the emission control device 270, temperature sensor 233, pressure sensor 291, and pressure sensor 282. Discussed herein, pressure sensor 291 may be referred to as fuel tank pressure transducer 2 (FTPT2), while pressure sensor 282 may be referred to as FTPT1. Other sensors such as pressure, temperature, air/fuel ratio, and composition sensors may be coupled to various locations in the vehicle system 206. As another example, the actuators may include throttle 262, fuel tank isolation valve 252, canister purge valve 261, and canister vent valve 297. The control system 214 may include a controller 212. The controller may receive input data from the various sensors, process the input data, and trigger the actuators in response to the processed input data based on instruction or code programmed therein corresponding to one or more routines. Example control routines are described herein with regard to FIGS. 3-4 and FIG. 7.

In some examples, the controller may be placed in a reduced power mode or sleep mode, wherein the controller maintains essential functions only, and operates with a lower battery consumption than in a corresponding awake mode. For example, the controller may be placed in a sleep mode following a vehicle-off event in order to perform a diagnostic routine at a duration after the vehicle-off event. The controller may have a wake input that allows the controller to be returned to an awake mode based on an input received from one or more sensors, or via expiration of a timer set such that when the timer expires the controller is returned to the awake mode. In some examples, the opening of a vehicle door may trigger a return to an awake mode. In other examples, the controller may need to be awake in order to conduct such methods. In such an example, the controller may stay awake for a duration referred to as a time period where the controller is maintained awake to perform extended shutdown functions, such that the controller may be awake to conduct evaporative emissions test diagnostic routines.

Undesired evaporative emissions detection routines may be intermittently performed by controller 212 on fuel system 218 and/or evaporative emissions system 251 to confirm that undesired evaporative emissions are not present in the fuel system and/or evaporative emissions system. As such, evaporative emissions detection routines may be performed while the engine is off (engine-off test) using engine-off natural vacuum (EONV) generated due to a change in temperature and pressure at the fuel tank following engine shutdown after a drive cycle. However, for a hybrid vehicle application, there may be limited engine run time, which may result in situations where EONV tests may not be robust due to, for example, a lack of heat rejection from the engine to the fuel tank. Similarly, evaporative emissions detection routines may be performed while the engine is running by using engine intake manifold vacuum to evacuate the evaporative emissions system and/or fuel system, but such opportunities may be sparse in a hybrid vehicle application.

Thus, undesired evaporative emissions detection routines may in some examples include a vacuum pump configured to apply a positive or negative pressure with respect to atmospheric pressure on the fuel system and/or evaporative emissions system. For example, a vacuum pump 289 may be configured in a vacuum pump conduit 294. The vacuum pump may comprise a rotary vane pump, a diaphragm pump, a liquid ring pump, a piston pump, a scroll pump, a screw pump, a wankel pump, etc., and may be understood to be in parallel with the CVV 297. The vacuum pump conduit 294 may be configured to route fluid flow (e.g. air and fuel vapors) from vent line 227, around canister vent valve 297. Vacuum pump conduit 294 may include a first check valve (CV1) 292, and second check valve (CV2) 293. When the vacuum pump 289 is activated, air may be drawn from vent line 227 between canister 222 and CVV 297, through vacuum pump conduit 294, back to vent line 227 at a position between canister vent valve 297 and atmosphere. In other words, the vacuum pump may be activated to evacuate the evaporative emissions system 251, and may further evacuate fuel system 218, provided that FTIV 252 and/or TPC valve 265 is commanded open via the controller. CV1 292 may comprise a pressure/vacuum-actuated valve that may open responsive to activating the vacuum pump to evacuate the fuel system and/or evaporative emissions system, and which may close responsive to the vacuum pump 289 being deactivated, or turned off. Similarly, CV2 may comprise a pressure/vacuum-actuated valve. When the vacuum pump 289 is activated to evacuate the fuel system and/or evaporative emissions system, CV2 293 may open to allow fluid flow to be routed from vacuum pump conduit 294 to atmosphere, and which may close responsive to the vacuum pump 289 being turned off. It may be understood that CVV 297 may be commanded closed in order to evacuate the fuel system and/or evaporative emissions system via the vacuum pump 289.

In the vehicle system 206 where the vacuum pump 289 is included, calibrations may be utilized in order to determine vacuum thresholds for indicating a presence or absence of undesired evaporative emissions. For example, there may be a 3D lookup table stored at the controller, which may enable determination of thresholds as a function of ambient temperature and fuel level. In the example vehicle system 206, a pressure sensor 282 is included, positioned in conduit 278. Thus, it may be understood that FTIV 252 is bounded by a fuel tank pressure sensor 291 (FTPT2) and pressure sensor 282 (FTPT1) positioned in conduit 278 between FTIV 252 and canister 222. In this way, under conditions where the FTIV is closed, pressure sensor 282 may monitor pressure in the evaporative emissions system, and pressure sensor 291 may monitor pressure in the fuel system.

As discussed, CVV 297 may function to adjust a flow of air and vapors between canister 222 and the atmosphere, and may be controlled during or prior to diagnostic routines. For example, the CVV may be opened during fuel vapor storing operations (for example, during fuel tank refueling) so that air, stripped of fuel vapor after having passed through the canister, can be pushed out to the atmosphere. Likewise, during purging operations (for example, during canister regeneration and while the engine is running), the CVV may be opened to allow a flow of fresh air to strip the fuel vapors stored in the canister. In the example vehicle system 206, the configuration of the vacuum pump 289 positioned in vacuum pump conduit 294 may allow for purging operations and refueling operations to be conducted without an undesirable additional restriction (the pump 289, and check valves CV1, CV2). In other words, during purging and refueling operations, the CVV may be commanded open, where flow of fluid through vacuum pump conduit 294 may be prevented via the check valves (CV1, CV2) and with the vacuum pump 289 deactivated.

In some examples, CVV 297 may be a solenoid valve wherein opening or closing of the valve is performed via actuation of a canister vent solenoid. In particular, the canister vent valve may be a normally open valve that is closed upon actuation of the canister vent solenoid. In some examples, CVV 297 may be configured as a latchable solenoid valve. In other words, when the valve is placed in a closed configuration, it latches closed without requiring additional current or voltage. For example, the valve may be closed with a 100 ms pulse, and then opened at a later time point with another 100 ms pulse. In this way, the amount of battery power required to maintain the CVV closed may be reduced.

Thus, one example of a test diagnostic for determining a presence or absence of undesired evaporative emissions using vacuum pump 289 may comprise closing the CVV and CPV, and activating the vacuum pump to evacuate the evaporative emissions system with the FTIV closed. If a threshold vacuum is reached (monitored via pressure sensor 282), an absence of gross undesired evaporative emissions may be indicated. Responsive to the indication of the absence of gross undesired evaporative emissions, the vacuum pump 289 may be stopped, or deactivated. With the vacuum pump 289 deactivated, CV1 292 (and CV2 293) may close, thus sealing the evaporative emissions system from atmosphere. Responsive to sealing the evaporative emissions system from atmosphere, pressure bleed-up may be monitored, and if pressure bleed-up is below a pressure bleed-up threshold, or if a pressure bleed-up rate is less than a pressure bleed-up rate threshold, an absence of non-gross undesired evaporative emissions in the evaporative emissions system may be indicated.

In similar fashion, the vacuum pump 289 may be utilized to evacuate the fuel system, with the FTIV open (e.g. actuated open via a command from the controller). If a threshold vacuum is reached (monitored via either pressure sensor 282 or FTPT2 291), then an absence of gross undesired evaporative emissions may be indicated. Responsive to the indication of the absence of gross undesired evaporative emissions stemming from the fuel system, the fuel system may be sealed via commanding closed the FTIV (e.g. actuating closed the FTIV via a command from the controller), and pressure bleed-up in the fuel system may be monitored. Responsive to an indication that pressure bleed-up is less than a pressure bleed-up threshold, or if a pressure bleed-up rate is less than a pressure bleed-up rate threshold, an absence of non-gross undesired evaporative emissions in the fuel system may be indicated (provided that the evaporative emissions system is known to be free from undesired evaporative emissions).

In still other examples, the fuel system and evaporative emissions system may be evacuated together with the FTIV open, and upon the threshold vacuum being reached, the fuel system and evaporative emissions system may be sealed from atmosphere, and further the fuel system and evaporative emissions system may be sealed from each other via the controller commanding closed the FTIV. In this way, pressure in the fuel system may be independently monitored from pressure in the evaporative emissions system, such that the fuel system may be diagnosed as to the presence or absence of undesired evaporative emissions independently of the evaporative emissions system.

As discussed above, it may be desirable to periodically assess working capacity of the fuel vapor storage canister 222, in order to determine whether the adsorption/desorption capacity of the fuel vapor storage canister has been compromised, and in some examples, to what extent. By assessing whether the adsorption/desorption capacity of the fuel vapor storage canister has been compromised, mitigating action may be taken to reduce or avoid release of undesired evaporative emissions to atmosphere which may otherwise result from such a situation where the fuel vapor storage canister is compromised. As discussed above and which will be elaborated further below, it may be desirable to assess working capacity of the fuel vapor storage canister without relying on one or more temperature sensor(s) embedded in the canister. In one example, working capacity of the fuel vapor storage canister may be assessed after a refueling event (see the method of FIG. 3 and related timeline of FIG. 5). In another example, working capacity of the fuel vapor storage canister may be assessed after a purging event (see the method of FIG. 4 and related timeline of FIG. 6).

Thus, the systems described above may enable a system for a vehicle, comprising a fuel vapor canister positioned in an evaporative emissions system of the vehicle, the evaporative emissions system selectively fluidically coupled to an engine via a canister purge valve, selectively fluidically coupled to a fuel tank via a fuel tank isolation valve, and selectively fluidically coupled to atmosphere via a canister vent valve. Such a system may further include a controller with computer readable instructions stored on non-transitory memory that, when executed, cause the controller to estimate a heat gain at the fuel vapor canister resulting from adsorption of fuel vapors by the fuel vapor canister during a refueling event of the fuel tank. The controller may store further instructions to set a vacuum build threshold as a function of the heat gain estimated from the refueling event. The controller may store further instructions to seal the evaporative emissions system from the engine, from the fuel tank, and from atmosphere by commanding closed the canister purge valve, the fuel tank isolation valve, and the canister vent valve. The controller may store further instructions to monitor a vacuum build in the sealed evaporative emissions system for a predetermined duration. The controller may store further instructions to indicate degradation of the fuel vapor canister in response to the vacuum build not reaching or exceeding the vacuum build threshold, and indicate that the fuel vapor canister is not degraded in response to the vacuum build reaching or exceeding the vacuum build threshold.

In such a system, the system may further comprise a fuel level indicator positioned in the fuel tank for monitoring fuel level. In such an example, the controller may store further instructions to estimate the heat gain at the fuel vapor canister based on an amount of fuel added to the fuel tank during the refueling event.

In such a system, the system may further comprise an ambient temperature sensor. In such an example, the controller may store further instructions to adjust the vacuum build threshold as a function of ambient temperature.

In such a system, the fuel vapor canister may not contain means for directly monitoring the heat gain at the canister, for example the fuel vapor canister may be free from one or more temperature sensor(s).

Turning now to FIG. 3, a high-level example method 300 is shown for conducting a working capacity diagnostic for a fuel vapor storage canister. Specifically, method 300 may be used to infer a fuel vapor canister working capacity subsequent to a refueling event by sealing the evaporative emissions system from engine intake, the fuel system, and from atmosphere and monitoring a vacuum-build, or in other words a negative pressure build with respect to atmospheric pressure. In this way, working capacity of the fuel vapor canister may be inferred based on a vacuum-build magnitude.

Method 300 will be described with reference to the systems described herein and shown in FIGS. 1-2, though it should be understood that similar methods may be applied to other systems without departing from the scope of this disclosure. Method 300 may be carried out by a controller, such as controller 212 in FIG. 2, and may be stored at the controller as executable instructions in non-transitory memory. Instructions for carrying out method 300 and the rest of the methods included herein may be executed by the controller based on instructions stored on a memory of the controller and in conjunction with signals received from sensors of the engine system, such as the sensors described above with reference to FIGS. 1-2. The controller may employ actuators such as FTIV (e.g. 252), CVV (e.g. 297), CPV (e.g. 261), etc., to alter states of devices in the physical world according to the methods depicted below.

Method 300 begins at 305, and includes estimating and/or measuring vehicle operating conditions. Operating conditions may be estimated, measured, and/or inferred, and may include one or more vehicle conditions, such as vehicle speed, vehicle location, etc., various engine conditions, such as engine status, engine load, engine speed, A/F ratio, manifold air pressure, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Proceeding to 310, method 300 includes indicating whether refueling is requested. For example, refueling may be requested via a vehicle operator depressing a refueling button (e.g. 197). In another example, refueling may be indicated to be requested based on proximity to a fuel filling station as monitored via, for example, an onboard navigation system (e.g. 132), and fuel level in the fuel tank. For example, when the vehicle is within a threshold distance of a fuel filling station and with fuel level below a particular fuel level threshold (e.g. less than 5% of capacity of the tank), refueling may be requested via the controller. If, at 310, it is indicated that refueling is not requested, method 300 may proceed to 315. At 315, method 300 may include maintaining current vehicle operating parameters. For example, if the engine is combusting air and fuel, such operation may be maintained. In another example, if the vehicle is being propelled, at least in part via electrical energy, such vehicle operation may be maintained. Furthermore, status of various valves such as FTIV, CPV, and CVV may be maintained in their current status. Method 300 may then end.

Returning to 310, in response to an indication that refueling is requested, method 300 may proceed to 320. At 320, method 300 may include depressurizing the fuel tank. Specifically, depressurizing the fuel tank at 320 may include commanding open the FTIV and the CVV (or maintaining open the CVV if the CVV is already open). By commanding open the FTIV and the CVV, the fuel tank may be coupled to atmosphere. It may be understood that under conditions where there is a standing positive pressure in the fuel tank, depressurizing the fuel tank may serve to load the canister with further fuel vapors. Because the canister as discussed in the context of the present disclosure is not equipped with canister temperature sensor(s) for monitoring canister loading, an amount of canister loading due to depressurization of the fuel tank may in some examples be inferred as a function of one or more of at least fuel temperature, pressure magnitude in the fuel tank just prior to depressurization, fuel level, and current inferred canister loading state. In this way, canister loading state may be updated in response to the depressurization event. It may be understood that the fuel tank may be indicated to be depressurized when pressure in the fuel tank drops below a depressurization threshold (e.g. within 5% of atmospheric pressure).

Accordingly, proceeding to 325, subsequent to fuel tank depressurization, method 300 may include recording estimated fuel vapor canister loading state, and fuel tank fill level. The estimated fuel vapor canister loading state may be, as mentioned above, a function of any fuel tank depressurization procedures that load the canister, any purge events which may have at least partially cleaned the canister, etc. Fuel tank fill level may be indicated via a fuel level indicator (e.g. 234). As will be discussed in further detail below, the fuel fill level in the fuel tank and the canister load prior to initiation of refueling may enable an estimation of an inferred canister loading state subsequent to the refueling event, which may be taken into account when determining fuel vapor canister working capacity.

With current estimated canister load and fuel tank fill level recorded at 325, method 300 may proceed to 330. At 330, method 300 may include monitoring fuel level during the refueling event, via the fuel level indicator. Proceeding to 335, method 300 may include indicating if refueling has stopped. For example, refueling may be indicated to be stopped when fuel level has plateaued. In another example, refueling may be indicated to have been stopped in response to a refueling dispenser being removed from a fuel filler neck of the fuel tank, replacement of a fuel cap, etc. If, at 335, refueling is not indicated to have stopped, method 300 may return to 330 where fuel level may continue to be monitored during refueling.

In response to an indication that refueling has stopped, method 300 may proceed to 340. At 340, method 300 may include indicating whether conditions are met for conducting the working capacity diagnostic for the fuel vapor canister. Conditions being met for conducting such a diagnostic may include an indication that the evaporative emissions system is free from any sources of undesired evaporative emissions. Conditions being met at 340 may additionally or alternatively include an indication that the fuel tank was filled during the refueling event by a threshold fill amount. In some examples the threshold fill amount may comprise 50% or more of fuel tank capacity. Conditions being met at 340 may additionally or alternatively include an indication that the fuel vapor canister working capacity diagnostic is requested. In some examples the working capacity diagnostic may be requested in response to a predetermined time duration (e.g. 2 days, 5 days, 10 days, greater than 10 days but less than 20 days, etc.) elapsing since a previous canister working capacity diagnostic was conducted. In other examples, the working capacity diagnostic may be requested in response to an indication that vapors are bleeding through the canister (monitored for example, via the hydrocarbon sensor positioned in the vent line) at a rate or amount greater than an expected rate or amount, thus indicating potential canister degradation. In still other examples, a working capacity diagnostic may be requested in response to an indication that the canister may have become contaminated with liquid fuel or other contaminants which may adversely impact canister function.

If, at 340, conditions are not indicated for conducting the working capacity diagnostic, method 300 may proceed to 345. At 345, method 300 may include sealing the fuel system, by commanding closed the FTIV. Continuing at 350, method 300 may include updating vehicle operating conditions. For example, inferred canister loading state as a function of the refueling event may be updated and stored at the controller. Current fuel level may be recorded to reflect the recent refueling event. A canister purge schedule may be updated to reflect the additional fuel vapors added to the canister during the refueling event. Method 300 may then end.

Returning to 340, responsive to conditions being indicated to be met for conducting the working capacity diagnostic, method 300 may proceed to 355. At 355, method 300 may include sealing the evaporative emissions system from atmosphere and from the fuel system. Specifically, at 355, the FTIV may be commanded closed and the CVV may too be commanded closed. The CPV may be maintained closed. In this way, the evaporative emissions system may be sealed from the fuel system and from atmosphere, as well as sealed from engine intake.

With the evaporative emissions system isolated, method 300 may proceed to 360. At 360, method 300 may include monitoring a vacuum-build in the sealed evaporative emissions system. Specifically, it may be understood that adsorption of fuel vapors via the fuel vapor canister comprises an exothermic process that results in a heat gain at the canister. Accordingly, an amount of heat generated at the canister reflects an amount of fuel vapor adsorbed during the refueling event. However, because in the context of the present disclosure there are not temperature sensor(s) present in the canister to enable the determination of an amount whereby the canister was loaded with fuel vapors, measuring an extent of vacuum build (e.g. negative pressure build with respect to atmospheric pressure) as the canister cools may provide an indication of how much vapor was adsorbed by the canister during the refueling event. Said another way, a working capacity of the canister may be inferred as a function of vacuum-build magnitude following an event where fuel vapors are added or adsorbed via the canister. Furthermore, by isolating the evaporative emissions system from the fuel system for determining the vacuum build, any fuel tank pressure may be isolated from the evaporative emissions system so as to not confound the vacuum-build measurement.

It is herein recognized that there may be a number of factors which may impact the vacuum-build subsequent to the refueling event. One such factor may be ambient temperature. For example, vacuum-build may be expected to be lower as ambient temperature increases. Another example may comprise heat rejection from the engine. For example, if the engine was relied upon for propelling the vehicle to the fuel filling station, then engine temperature may remain elevated during the refueling event and heat rejection from the engine may impact vacuum-build magnitude. In another example, if the vehicle is driven while the vacuum-build is being monitored, wind may cool the canister which may increase vacuum-build as compared to a situation where the vehicle remains stationary during the vacuum-build.

Thus, the controller of the vehicle may factor in a number of variables in order to set a vacuum-build threshold corresponding to an expected vacuum-build in the sealed evaporative emissions system. Such variables may be stored at the controller as one or more lookup tables, for example 2D or 3D lookup tables. Specifically, the vacuum-build threshold may be set based on an assumption that the canister is functioning as desired or expected. In other words, that the working capacity of the canister has not become degraded to any significant extent. As an example, a canister may be designed with a typical 10% reserve, and thus during a refueling event where the fuel tank is filled to capacity from an empty state (and where the canister is clean), it may be expected that the canister adsorb 90% of its capacity provided the canister is functioning as desired or expected. Based on this assumption, an estimated amount of fuel vapors expected to have been adsorbed by the canister provided the canister is functioning as desired, may be inferred for a given refueling event. The estimated amount of fuel vapors may enable an estimation of a heat gain expected at the canister due to the fuel vapors being adsorbed by the canister. The estimated amount of fuel vapors expected to have been adsorbed may be a function of one or more of amount of fuel added to the tank during the particular refueling event, reid vapor pressure of the fuel being added to the fuel tank, fuel tank temperature, fuel temperature, ambient temperature, and inferred canister loading state just prior to such a refueling event. From the estimated amount of fuel vapors expected to have been adsorbed by the canister for a given refueling event where a measured amount of fuel has been added to the tank, an expected vacuum build or said another way, the vacuum build threshold may be inferred as a function of the expected canister heat gain extrapolated from the estimated amount of fuel vapors adsorbed via the canister. As discussed, the vacuum build magnitude may additionally be dependent on a number of factors such as ambient temperature, wind, engine heat rejection, etc., and thus the vacuum-build threshold may be adjusted as a function of such variables. In some examples, the working capacity diagnostic may be conducted while the vehicle is stationary, in order to avoid the potentially confounding issue of wind cooling the canister and influencing vacuum build magnitude. However, in other examples the vacuum build threshold may be adjusted accordingly if the vehicle is propelled while the vacuum build is being monitored. Specifically, the vacuum build threshold may be adjusted as a function of vehicle speed, for example.

It may be understood that given the above-described methodology for inferring an expected vacuum build subsequent to a refueling event, the vacuum build threshold may comprise a threshold whereby, if the vacuum build reaches or exceeds (e.g. becomes more negative) the vacuum build threshold, it may be inferred that the canister is not degraded. In other words, in a situation where the vacuum build reaches or exceeds the vacuum build threshold it may be inferred that the canister adsorbed the inferred amount of fuel vapors generated during the refueling event, without any significant amount of fuel vapors flowing through the canister and out to atmosphere via the vent line.

Accordingly, proceeding to step 370, method 300 may include indicating whether the vacuum build as monitored at step 360 reached or exceeded the vacuum build threshold set based on the methodology laid forth above. If, at 370, the vacuum build reached or exceeded the vacuum build threshold, method 300 may proceed to 375. At 375, method 300 may include indicating the canister is functioning as desired or expected. Said another way, at 375, it may be indicated that the canister is not degraded or in other words that the working capacity of the canister has not become degraded to any significant extent. Such a result may be stored at the controller.

With the results of the diagnostic stored at the controller, method 300 may proceed to 380. At 380, method 300 may include fluidically coupling the evaporative emissions system to atmosphere. Coupling the evaporative emissions system to atmosphere may include commanding open the CVV, for example. In this way, pressure in the evaporative emissions system may return to atmospheric pressure.

Continuing to 385, method 300 may include updating vehicle operating conditions. In one example, updating vehicle operating conditions may include updating a canister purge schedule to reflect the refueling event, such that the canister is cleaned of adsorbed fuel vapors at the first opportunity where conditions are met for doing so. Updating vehicle operating conditions at 385 may in some examples include updating fuel level of fuel stored in the fuel tank, to reflect the refueling event. Method 300 may then end.

Returning to 370, in a situation where the vacuum build did not reach or exceed the vacuum build threshold, method 300 may proceed to 390. At 390, method 300 may include indicating that the canister is degraded. Said another way, at 390 it may be indicated that the working capacity of the canister has become degraded to some extent. Such a result may be stored at the controller. While not explicitly illustrated, it may be understood that in some examples, the relationship between the vacuum build and the vacuum build threshold may allow for indicating an extent to which the canister is degraded, or in other words, a more precise indication of a current working capacity of the canister, rather than just an indication of degradation or no degradation. For example, if the vacuum build magnitude reaches 50% of the expected vacuum build as set by the vacuum build threshold, then it may be inferred that the current working capacity is roughly half of what is desired or expected. In another example, if the vacuum build magnitude reaches 20% of the expected vacuum build as set by the vacuum build threshold, then it may be inferred that the current working capacity of the canister is only ⅕ of the desired or expected working capacity. Such examples are meant to be illustrative, and it may be understood that correlations between monitored vacuum build and the vacuum build threshold may be stored at one or more lookup tables, such that it may readily be inferred as to an extent by which the canister is degraded. The results of the test diagnostic may be stored at the controller at 390.

Proceeding to 380, method 300 may include coupling the evaporative emissions system to atmosphere via commanding open the CVV as discussed above. Continuing to 385, method 300 may include updating vehicle operating conditions. Updating vehicle operating conditions may include setting a flag at the controller to reflect the canister degradation (and in some cases the extent of canister degradation), and may further include illuminating a malfunction indicator light (MIL) at the vehicle dash, alerting the vehicle operator of a request to service the vehicle.

In some examples, at 385, vehicle operating conditions may be updated as a function of the extent of canister degradation, or in other words, as a function of the inferred current working capacity of the canister. For example, in a situation where the current working capacity of the canister is inferred to be less than a threshold (e.g. 50% or less), mitigating action may be taken to alert the vehicle operator to avoid refueling the vehicle if possible, until the issue with canister degradation has been remedied. Such an alert may comprise an indication at the vehicle dash, for example via a human machine interface (HMI), an audible alert, or any other alert which may communicate such information to the vehicle operator. In this way, release of undesired evaporative emissions to atmosphere may be reduced or avoided in situations where working capacity of the canister has become significantly degraded. In other examples, canister purging may be scheduled to occur more frequently than a current schedule, to reduce potential release of fuel vapors to atmosphere. Method 300 may then end.

As discussed in detail above, a refueling event that loads the canister with refueling vapors and thus generates heat at the canister may comprise a situation whereby current working capacity of the canister may be inferred based on a vacuum build magnitude in the sealed evaporative emissions system subsequent to the refueling event. It is herein additionally recognized that in another example, specifically a purging event of the canister where fuel vapors are desorbed from the canister, the canister may cool and thus a subsequent pressure build in the evaporative emissions system (similarly sealed as described above) as the canister warms may be indicative of current working capacity of the canister.

Accordingly, turning now to FIG. 4, a high-level example method 400 is shown for conducting another example of a working capacity diagnostic for the fuel vapor storage canister. Specifically, method 400 may be used to infer a fuel vapor canister working capacity subsequent to a purging event by sealing the evaporative emissions system from engine intake, the fuel system, and from atmosphere, and monitoring a pressure build (e.g. positive pressure build with respect to atmospheric pressure), the pressure build resulting from the canister warming subsequent to being cooled via the process of fuel vapor desorption during the purging event. In this way, current working capacity of the fuel vapor canister may be inferred based on a pressure build magnitude.

Method 400 will be described with reference to the systems described herein and shown in FIGS. 1-2, though it should be understood that similar methods may be applied to other systems without departing from the scope of this disclosure. Method 400 may be carried out by a controller, such as controller 212 in FIG. 2, and may be stored at the controller as executable instructions in non-transitory memory. Instructions for carrying out method 400 and the rest of the methods included herein may be executed by the controller based on instructions stored on a memory of the controller and in conjunction with signals received from sensors of the engine system, such as the sensors described above with reference to FIGS. 1-2. The controller may employ actuators such as FTIV (e.g. 252), CVV (e.g. 297), CPV (e.g. 261), etc., to alter states of devices in the physical world according to the methods depicted below.

Method 400 begins at 405, and includes estimating and/or measuring vehicle operating conditions. Operating conditions may be estimated, measured, and/or inferred, and may include one or more vehicle conditions, such as vehicle speed, vehicle location, etc., various engine conditions, such as engine status, engine load, engine speed, A/F ratio, manifold air pressure, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Continuing to 410, method 400 includes indicating whether purging of the fuel vapor canister is requested. In some examples, purging may be requested via the controller based on a purge schedule. Additionally or alternatively, purging may be requested in response to an indication/inference of a loading state of the canister, and/or in response to an intake manifold vacuum sufficient to initiate purging of the canister. Said another way, purging may be requested in response to conditions being met for doing so, which may include an indication of a canister loading state inferred to be above a predetermined threshold (e.g. greater than 50% loaded, greater than 40% loaded, etc.), and an intake manifold vacuum indicated to be above a predetermined threshold, the predetermined threshold intake manifold vacuum comprising a level of vacuum sufficient for purging the canister (e.g. sufficient to purge the canister until the canister loading state is 5% loaded or less).

If, at 410, purging of the canister is not indicated to be requested, method 400 may proceed to 415. At 415, method 400 may include maintaining current vehicle operating parameters. For example, the CPV may be maintained closed so as to prevent fuel vapors from being inducted into the engine. If the vehicle is being propelled via the engine, then such operation may be maintained. If the vehicle is being propelled at least in part via electrical energy, then such operation may be maintained. Method 400 may then end.

Returning to 410, in response to an indication of a request for purging of the canister, method 400 may proceed to 420. At 420, method 400 may include inferring canister loading state prior to initiating the canister purging operation. For example, as discussed in detail above at FIG. 3, canister loading state may be inferred based on an amount of refueling vapors expected or inferred to have loaded the canister, provided (or under the assumption) that the canister is functioning as desired or expected. In other examples comprising a situation where the canister has been partially purged of fuel vapors at an earlier time and where a subsequent refueling event has not occurred, canister loading state may be inferred based on a fuel fraction calculation during purging, the fuel fraction calculation based on output from an exhaust gas oxygen sensor (e.g. 237), where such a result may be stored at the controller to indicate inferred canister loading state.

Proceeding to 425, method 400 may include conducting the purging operation to purge the contents of the canister to engine intake for combustion. Specifically, at 425, method 400 may include commanding open the CPV and commanding open or maintaining open the CVV. The FTIV and TPC valve may be maintained closed in this particular methodology so as to not additionally draw fuel vapors from the fuel tank to engine intake. While not explicitly illustrated, it may be understood that in some examples, rather than commanding open the CPV, the CPV may be duty cycled at an initial rate, and ramped up over time as a function of fuel vapors inducted into the engine (as monitored via the exhaust gas sensor), so as to avoid engine hesitation or stall due to induction of a rich quantity of fuel vapor.

During the purging, the controller may maintain a desired air-fuel ratio at 426 by controlling fuel injection amount and/or timing, controlling an extent of opening of the throttle (e.g. 262), controlling CPV duty cycle, etc. Furthermore, based on the output from the exhaust gas sensor(s), canister loading state may be inferred as a function of the purging event at 427.

Proceeding to 430, method 400 may include indicating whether conditions continue to be met for conducting the purging operation. Conditions continuing to be met may include an indication that intake manifold vacuum remains above the predetermined threshold intake manifold vacuum, and may additionally include an indication that the canister has not yet been sufficiently cleaned (e.g. 5% loaded or less). In response to conditions continuing to be met for conducting the purging operation, method 400 may return to 425. Alternatively, in response to conditions no longer being indicated to be met for conducting the purging operation, method 400 may proceed to 435.

At 435, method 400 may include indicating whether conditions are met for conducting a working capacity diagnostic on the canister. Discussed herein, the working capacity diagnostic corresponding to method 400 may be referred to as a pressure-based working capacity diagnostic, whereas the working capacity diagnostic corresponding to method 300 may be referred to as a vacuum-based working capacity diagnostic.

Conditions being met for conducting the working capacity diagnostic at 435 may include an indication that the canister has been cleaned to a predetermined threshold, the predetermined threshold comprising at least 50% of the canister having been cleaned of vapors, as an example. Such a determination may be inferred based on output from the exhaust gas sensor(s) and may be further based on initial inferred canister loading state. However, such an example is illustrative and the predetermined threshold to which the fuel vapor canister has been cleaned may comprise other examples such as at least 40%, at least 30%, etc. Conditions being met at 435 may in some examples include an indication that the evaporative emissions system is free from any sources of undesired evaporative emissions. Conditions being met at 435 may in some examples include an indication that a predetermined amount of time (2 days, 5 days, 10 days, greater than 10 days but less than 20 days, etc.) has elapsed since a prior working capacity diagnostic (either pressure-based or vacuum-based) has been conducted. In some examples, conditions being met at 435 may include an indication of a level of fuel vapor bleedthrough from the canister greater than that expected if the canister were not degraded, monitored for example via the hydrocarbon sensor positioned in the vent line.

In some examples, the pressure-based working capacity diagnostic may serve as a rationality test for the vacuum-based working capacity diagnostic. For example, as discussed above at FIG. 3, after a refueling event a vacuum-based working capacity diagnostic may be conducted. In such a case, an expected amount of fuel vapors may be inferred to have been adsorbed by the canister (and thereby an expected heat gain at the canister), under the assumption that the canister working capacity has not become significantly degraded. Based on the expected or inferred heat gain, the vacuum-based working capacity diagnostic may be conducted per FIG. 3, to determine whether the fuel vapor canister is adsorbing fuel vapors as expected or desired, and such a result may be stored at the controller as discussed. Given that such a diagnostic includes the determination of the expected amount of fuel vapors adsorbed by the canister, an estimated canister loading state may be inferred and may be relied upon for conducting the pressure-based working capacity diagnostic. For example, if it is inferred that the canister is expected or inferred to be loaded to 75% capacity, then if the canister is purged completely (e.g. to a less than 5% load), an estimated pressure build upon sealing the evaporative emissions system may be determined based on an extrapolated inference as to an extent to which the canister is expected to cool based on the purging event. By comparing the estimated pressure build, also referred to herein as a pressure build threshold, to an actual monitored pressure build, current working capacity of the canister may again be determined and compared with the results of the vacuum-based working capacity diagnostic. If the results of the vacuum-based diagnostic correspond, or in other words are in agreement with, the results of the pressure-based diagnostic, then it may be determined with high confidence a current working capacity of the canister.

While the above description provides an example scenario where the pressure-based working capacity diagnostic serves as a rationality check for the vacuum-based working capacity, there may be other examples where the pressure-based working capacity diagnostic may be conducted in lieu of the vacuum-based working capacity diagnostic. For example, there may be circumstances where the vacuum-based working capacity diagnostic is not conducted after a refueling event because the refueling event included the addition of an amount of fuel less than 50%. However, while a small additional amount of fuel added to the fuel tank may load the canister a small amount, if the canister is already loaded to a significant extent with fuel vapors, then the additional amount may increase the overall loading state. In such an example it may be desirable to conduct the pressure-based working capacity diagnostic without first conducting the vacuum-based diagnostic.

There may be other examples where the pressure-based working capacity diagnostic may be conducted in lieu of the vacuum-based diagnostic. For example, if certain parameters such as high ambient temperature and/or a high level of heat rejection from the engine are expected to adversely impact the vacuum-based diagnostic, then the vacuum-based diagnostic may not be conducted and instead the pressure-based diagnostic of FIG. 4 may be scheduled.

Accordingly, at 435, if conditions are not indicated to be met for conducting the pressure-based working capacity diagnostic, method 400 may proceed to 440. At 440, method 400 may include commanding closed the CPV to seal the evaporative emissions system from engine intake. Proceeding to 445, method 400 may include updating vehicle operating parameters. Updating vehicle operating parameters at 445 may include updating the canister loading state to reflect the recent purging event, and may further include updating a canister purge schedule as a function of the purging event. Method 400 may then end.

Returning to 435, responsive to conditions being indicated to be met for conducting the pressure-based working capacity diagnostic, method 400 may proceed to 450. At 450, method 400 may include sealing the evaporative emissions system from engine intake, from atmosphere, and from the fuel system. Specifically, the CPV may be commanded closed, the CVV may be commanded closed, and the FTIV may be commanded or maintained closed. Similarly, the TPC valve may be commanded or maintained closed.

Proceeding to 455, with the evaporative emissions system sealed, a pressure build may be monitored in the evaporative emissions system. It is herein recognized that there may be a number of factors which may impact the pressure-build subsequent to the purging event where the canister is cooled via the endothermic process of fuel vapor desorption. One such factor may be ambient temperature. For example, the pressure-build may be expected to be lesser as ambient temperature decreases. Vehicle speed may contribute to air flow in the vicinity of the canister, which may cool the canister and reduce pressure-build, as another example.

Thus, the controller of the vehicle may factor in one or more variables in order to set a pressure-build threshold corresponding to an expected pressure-build in the sealed evaporative emissions system subsequent to a canister purging event. Such variables may be stored at the controller as one or more lookup tables, for example 2D or 3D lookup tables. Specifically, the pressure-build threshold may be set based on an assumption that the canister is functioning as desired or expected. In other words, that the working capacity of the canister has not become degraded to any significant extent. In an example where the pressure-based working capacity diagnostic is being relied upon as a rationality test for the vacuum-build working capacity diagnostic, it may be understood that the pressure-build threshold may still be set based on the assumption that the canister working capacity is not degraded, even though there may be evidence to the contrary. In this way, the results of the two test diagnostics (pressure-based diagnostic and vacuum-based diagnostic) may be compared without inherent bias, for example bias in the pressure-based diagnostic stemming from the results of the vacuum-based diagnostic.

The pressure build threshold may be based on an extent to which the canister has been inferred to have been cleaned during the purging event, and initial inferred loading state of the canister just prior to the purging event. For example, as more vapors are purged from the canister, the canister may cool to a greater extent. The cooler the canister, the greater an expected pressure build subsequent to the purging event and subsequent to the evaporative emissions system being sealed. Because the canister of the present disclosure does not have means for directly monitoring canister temperature, expected pressure build may be based on an inferred amount of vapors desorbed from the canister, where the inferred amount of vapors desorbed is used via the controller to estimate an amount of cooling of the canister resulting from the purging operation. As discussed, the pressure build magnitude may additionally be dependent on a number of factors such as ambient temperature, wind, vehicle speed, engine heat rejection, etc., and thus the pressure-build threshold may be adjusted as a function of such variables.

It may be understood that given the above-described methodology for inferring an expected pressure build subsequent to a refueling event, the pressure build threshold may comprise a threshold whereby, if the pressure build reaches or exceeds (e.g. becomes more positive) the pressure build threshold, it may be inferred that the canister working capacity is not degraded to any significant extent. Alternatively, if the pressure build does not reach or exceed the pressure build threshold, then it may be inferred that there is some level of degradation related to the working capacity of the canister.

Accordingly, proceeding to 465, method 400 may include indicating whether the pressure build reaches or exceeds the pressure build threshold. If, at 465, the pressure build is indicated to have reached or exceeded the pressure build threshold, then method 400 may proceed to 470. At 470, method 400 may include indicating that the canister is functioning as desired or expected. In other words, at 470, it may be indicated that canister working capacity has not become degraded to any significant extent. Such a result may be stored at the controller. Continuing to 475, method 400 may include fluidically coupling the evaporative emissions system to atmosphere by commanding open the CVV. In this way, pressure in the evaporative emissions system may be returned to atmospheric pressure. Proceeding to 480, vehicle operating conditions may be updated. For example, a canister purging schedule may be updated to reflect the purging operation, and a loading state of the canister may be updated. Method 400 may then end.

Returning to 465, in a situation where the pressure build did not reach or exceed the pressure build threshold, method 400 may proceed to 485. At 485, method 400 may include indicating that the canister is degraded. Said another way, at 485 it may be indicated that the working capacity of the canister has become degraded to some extent. Such a result may be stored at the controller. While not explicitly illustrated, it may be understood that in some examples, the relationship between the pressure build and the pressure build threshold may allow for indicating an extent to which the canister is degraded, or in other words, an indication of a current working capacity of the canister. For example, if the pressure build magnitude reaches 50% of the expected pressure build as set by the pressure build threshold, then it may be inferred that the current working capacity is roughly half of what is expected or desired. In another example, if the pressure build magnitude reaches 20% of the expected pressure build as set by the pressure build threshold, then it may be inferred that the current working capacity of the canister is only ⅕ of the desired or expected working capacity. Such examples are meant to be illustrative, and it may be understood that correlations between monitored pressure build and the pressure build threshold may be stored at one or more lookup tables, such that it may readily be inferred as to an extent by which the canister is degraded. The results of the test diagnostic may be stored at the controller at 485.

Proceeding to 475, method 400 may include coupling the evaporative emissions system to atmosphere, by commanding open the CVV as discussed above. Continuing to 480, method 400 may include updating vehicle operating conditions. Updating vehicle operating conditions may include setting a flag at the controller to reflect the canister degradation (and in some cases the extent of canister degradation), and may further include illuminating a malfunction indicator light (MIL) at the vehicle dash, alerting the vehicle operator of a request to service the vehicle.

In some examples, at 480, vehicle operating conditions may be updated as a function of the extent of canister degradation, or in other words, as a function of the inferred current working capacity of the canister. For example, in a situation where the current working capacity of the canister is inferred to be less than a threshold (e.g. 50% or less), mitigating action may be taken to alert the vehicle operator to avoid refueling the vehicle if possible, until the issue with canister degradation has been remedied. Such an alert may comprise an indication at the vehicle dash, for example via a human machine interface (HMI), an audible alert, or any other alert which may communicate such information to the vehicle operator. In this way, release of undesired evaporative emissions to atmosphere may be reduced or avoided in situations where working capacity of the canister has become significantly degraded. Method 400 may then end.

As discussed above, in some examples the pressure-based working capacity diagnostic may be conducted as a rationality test for the vacuum-based diagnostic. Accordingly, turning to FIG. 7, an example methodology is depicted, illustrating how the results of such tests may be compared. Method 700 will be described with reference to the systems described herein and shown in FIGS. 1-2, though it should be understood that similar methods may be applied to other systems without departing from the scope of this disclosure. Method 700 may be carried out by a controller, such as controller 212 in FIG. 2, and may be stored at the controller as executable instructions in non-transitory memory. Instructions for carrying out method 700 and the rest of the methods included herein may be executed by the controller based on instructions stored on a memory of the controller and in conjunction with signals received from sensors of the engine system, such as the sensors described above with reference to FIGS. 1-2. The controller may employ actuators such as FTIV (e.g. 252), CVV (e.g. 297), CPV (e.g. 261), etc., to alter states of devices in the physical world as discussed above.

Method 700 begins at 705 and includes conducting the vacuum-based working capacity diagnostic according to the methodology depicted at FIG. 3. The results of such a test may be stored at the controller. Continuing to 710, method 700 may include conducting the pressure based working capacity diagnostic according to the methodology depicted at FIG. 4. It may be understood that for conducting the methodology of FIG. 7, the vacuum-based diagnostic at 705 may be conducted after a refueling event, and then the pressure-based diagnostic may then be conducted at 710 without another purge event in between. Said another way, the purging event associated with step 710 for conducting the pressure-based diagnostic may be understood to purge the fuel vapors loaded to the canister due to the refueling event associated with the vacuum-based working capacity diagnostic. Similar to that discussed for step 705, at step 710, the results of the test may be stored at the controller.

Proceeding to 715, method 700 includes indicating whether the results of the vacuum-based diagnostic and the pressure-based diagnostic are correlated. For example, if the vacuum build corresponding to the vacuum-based diagnostic reached or exceeded the vacuum build threshold, and if the pressure build corresponding to the pressure-based diagnostic reached or exceeded the pressure build threshold, then it may be understood that the results are correlated. Similarly, if the vacuum build corresponding to the vacuum-based diagnostic did not reach or exceed the vacuum build threshold, and if the pressure build corresponding to the pressure-based diagnostic did not reach or exceed the pressure build threshold, then it may be understood that the results are correlated. Alternatively, it may be understood that the results are not correlated if one of the tests indicate that the canister is not degraded while the other test indicates that the canister is degraded.

As discussed above, in some examples an extent to which the canister is degraded may be inferred based on the difference between monitored pressure (e.g. positive pressure build or vacuum build) and the pressure threshold (e.g. pressure build threshold or vacuum build threshold). As an example, the vacuum-based diagnostic may indicate that the canister working capacity is at 50%, whereas the pressure-based diagnostic may indicate that the canister working capacity is at 60%. In such scenarios, the results may be indicated to be correlated, and the results of each test may be averaged together to arrive at an adjusted current working capacity. For example, taking the above-mentioned example, 50% plus 60% divided by two equals 55%. Such a calculation may be carried out via the controller, indicating that the adjusted current working capacity is 55%. Such an example is meant to be illustrative.

Accordingly, at 715, if the results are indicated to be correlated, method 700 may proceed to 720. At 720, method 700 may include storing the results at the controller, and updating vehicle operating parameters to reflect the determination of a presence or absence of canister degradation, as discussed above. Method 700 may then end. Alternatively, if at 715 the results are indicated to not be correlated, method 700 may proceed to 725, where the results may be discarded. Because the tests were not conclusive, follow-up test(s) may be scheduled to ascertain working capacity of the canister. Vehicle operating parameters may be updated to reflect the results of the combined tests. Method 700 may then end.

While the above example depicts the vacuum-based working capacity diagnostic being conducted prior to the pressure-based working capacity diagnostic, where the pressure-based diagnostic is relied upon as a rationality test for the vacuum-based diagnostic, it is herein recognized that in other examples, the vacuum-based diagnostic may be relied upon as a rationalization test for the pressure-based diagnostic without departing from the scope of this disclosure.

Thus, in one example, a method may comprise, in response to fuel vapors being adsorbed by, or desorbed from, a fuel vapor canister positioned in an evaporative emissions system of a vehicle, the fuel vapor canister capturing/storing fuel tank fuel vapors, sealing the evaporative emissions system and indicating degradation of the fuel vapor canister in response to a monitored pressure change in the evaporative emissions system less than a threshold pressure change.

In such a method, adsorption of fuel vapors by the fuel vapor canister generates heat at the fuel vapor canister, and desorption of fuel vapors by the fuel vapor canister results in a cooling of the fuel vapor canister.

In such a method, sealing the evaporative emissions system may include sealing the evaporative emissions system from an engine of the vehicle, the fuel tank, and from atmosphere.

In such a method, fuel vapors being adsorbed to the fuel vapor canister may further comprise a refueling event that loads the fuel vapor canister with fuel vapors.

In such a method, fuel vapors being desorbed from the fuel vapor canister may comprise a purging operation of the fuel vapor canister.

In such a method, the threshold pressure change may comprise a positive threshold pressure change with respect to atmospheric pressure in response to fuel vapors being desorbed from the fuel vapor canister.

In such a method, the threshold pressure change may comprise a negative threshold pressure change with respect to atmospheric pressure in response to fuel vapor being adsorbed to the fuel vapor canister.

In such a method, the threshold pressure change is set by a controller of the vehicle as a function of an amount of fuel vapors adsorbed by, or desorbed from, the fuel vapor canister.

In such a method, the threshold pressure change may be adjusted to compensate for one or more of ambient temperature, wind, heat generation related to vehicle componentry in proximity to the fuel vapor canister, and a speed of the vehicle.

In such a method, the method may further comprise indicating an extent of fuel vapor canister degradation based on a relationship between the monitored pressure change and the threshold pressure change.

In such a method, the fuel vapor canister does not include one or more temperature sensor(s) or other means of directly measuring temperature of the fuel vapor canister.

Another example of a method comprises in response to a refueling event where a fuel tank of a vehicle is filled by at least a threshold amount, inferring a heat gain by a fuel vapor canister positioned in an evaporative emissions system of the vehicle as a function of the refueling event, where the fuel vapor canister captures and stores fuel vapors from a fuel tank of the vehicle during the refueling event; setting a vacuum-build threshold based on the inferred heat gain; sealing the evaporative emissions system from the fuel tank, from an engine of the vehicle, and from atmosphere; and indicating an absence of degradation of the fuel vapor canister in response to a monitored pressure in the sealed evaporative emissions system reaching or exceeding the vacuum-build threshold.

In such a method, the threshold amount may comprise at least fifty percent of a capacity of the fuel tank.

In such a method, inferring the heat gain may include an assumption that the fuel vapor canister is not degraded to any measurable extent.

In such a method, inferring the heat gain may be based on an amount of fuel added to the fuel tank during the refueling event, and may further be a function of one or more parameters related to fuel vaporization.

In such a method, the vacuum-build threshold may further be a function of one or more of ambient temperature, an amount of heat rejection from the engine, a speed of the vehicle, and one or more other environmental parameters.

Turning now to FIG. 5, an example timeline 500 illustrating a vacuum-based working capacity diagnostic, is shown. Specifically, timeline 500 depicts a scenario where a refueling event is conducted, and then the evaporative emissions system is sealed and a vacuum build monitored and compared to a vacuum-build threshold in order to ascertain whether the canister is degraded. Timeline 500 includes plot 505, indicating whether refueling is requested (yes) or not (no), over time. Timeline 500 further includes plot 510, indicating whether conditions are met for conducting the vacuum-based working capacity diagnostic (yes) or not (no), over time. Timeline 500 further includes plot 515, indicating CVV status, plot 520, indicating FTIV status, and plot 525, indicating CPV status, over time. For each of plot 515, 520, and 525, the respective valves may be open or closed. Timeline 500 further includes plot 530, indicating pressure in the evaporative emissions system as monitored by FTPT1 (e.g. 282), over time. Pressure in the evaporative emissions system may be either at atmospheric pressure, or may be positive (+) or negative (−) with respect to atmospheric pressure. Timeline 500 further includes plot 535, indicating fuel system pressure as monitored by FTPT2 (e.g. 291), over time. In this example timeline, pressure in the fuel system may be either at atmospheric pressure, or may be positive (+) with respect to atmospheric pressure, over time. Timeline 500 further includes plot 540, indicating fuel level in the fuel tank, monitored for example via an FLI (e.g. 234), over time. Timeline 500 further includes plot 545, indicating whether the canister is degraded (yes) or not (no), over time.

At time t0, refueling is not requested (plot 505), and conditions are not yet indicated to be met for conducting the vacuum-based working capacity diagnostic (plot 510). The CVV is open (plot 515), and the FTIV is closed (plot 520). The CPV is also closed (plot 525). While not explicitly illustrated, it may be understood that the TPC valve (e.g. 265) is also closed. Pressure in the evaporative emissions system is near atmospheric pressure (plot 530), as the CVV is open. Pressure in the fuel system is positive with respect to atmospheric pressure (plot 535), as the fuel system is sealed. Fuel level in the tank is low (plot 540), and as of time t0 canister degradation is not indicated.

At time t1, refueling is requested. As one example, a vehicle operator depresses a refueling button (e.g. 197) in order to request refueling. With refueling requested, at time t2 the FTIV is commanded open (plot 520) in order to depressurize the fuel system. Accordingly, between time t2 and t3, pressure in the fuel system decays to atmospheric pressure. With the fuel system at atmospheric pressure at time t3, access to the fuel tank is unlocked and refueling commences. Between time t3 and t4, fuel is added to the tank, as monitored via the FLI (plot 540). With fuel being added to the tank, pressure in the fuel tank increases and plateaus, and evaporative emissions system pressure increases above atmospheric pressure as well. At time t4, refueling is stopped. In some examples refueling may be stopped automatically due to a pressure-based fuel dispenser shut-off mechanism when fuel level reaches capacity of the tank, however in this example it may be understood that the refueling event is stopped without an automatic shutoff event of the dispenser.

With refueling stopped at time t4, pressure in the fuel system returns to atmospheric pressure (plot 535) as does pressure in the evaporative emissions system (plot 530). At time t5, refueling is no longer indicated to be requested (plot 505). For example, a gas cap may be replaced, fuel door locked, fuel dispenser removed from the fuel filler neck, etc. Furthermore, at time t5, it is indicated that conditions are met for conducting the vacuum-based working capacity diagnostic. Such conditions have been described in detail above at step 340 of method 300, and will not be reiterated here for brevity. With conditions being indicated to be met for conducting the vacuum-based working capacity diagnostic at time t5, the CVV (plot 515) and the FTIV (plot 520) are commanded closed. The CPV is maintained closed (plot 525). In this way, the evaporative emissions system is sealed from atmosphere, engine intake, and from the fuel system.

A vacuum-build threshold 531 is set as a function of the refueling event, and a number of other variables which may impact the vacuum-build portion of the vacuum-based working capacity diagnostic. More specifically, an amount of fuel vapors expected to have been adsorbed by the canister (under the assumption that the working capacity of the canister is not degraded to any significant extent) may be inferred as a function of one or more of amount of fuel added to the tank, reid vapor pressure of the fuel added, fuel temperature, canister loading state prior to the refueling event, ambient temperature, etc. Based on the amount of fuel vapors inferred to have been adsorbed by the canister during the refueling event, and thereby an inferred heat gain at the canister, it may then be inferred as to a vacuum build magnitude expected in the sealed evaporative emissions system as the canister cools. As discussed above with regard to FIG. 3, there may be variables which impact how much vacuum may develop, where such variables may include ambient temperature, heat rejection amount from the engine, wind, vehicle speed, etc. Thus, expected vacuum magnitude may be adjusted to compensate for variables such as ambient temperature, engine heat rejection (e.g. mass air flow summed over the previous drive cycle), wind, etc., in order to set the vacuum-build threshold 531. Between time t6 and t7, the vacuum build is monitored in the evaporative emissions system (plot 530). It may be understood that the vacuum build may be monitored for a predetermined time period. In this example timeline 500, it may be understood that the predetermined time period corresponds to the time spanning time t6 and t7.

At time t7, the predetermined time period elapses with the vacuum build (plot 530) not reaching or exceeding the vacuum build threshold 531. Accordingly, at time t7 canister degradation is indicated (plot 545). While not explicitly illustrated, it may be understood that in some examples a more precise indication of how degraded the canister working capacity has become may be inferred by comparing the extent of vacuum build with the vacuum-build threshold, as discussed above with regard to FIG. 3. With canister degradation indicated at time t7, conditions are no longer met for conducting the vacuum-based working capacity diagnostic (plot 510), and accordingly, the CVV is commanded open (plot 515). With the CVV commanded open, pressure in the evaporative emissions system returns to atmospheric pressure (plot 530).

Turning now to FIG. 6, another example timeline 600 is depicted, illustrating how a pressure-based working capacity diagnostic for a fuel vapor storage canister may be conducted. Timeline 600 includes plot 605 indicating whether a canister purging operation is requested (yes or no), plot 610, indicating whether conditions are met for purging the canister (yes or no), and plot 615, indicating whether conditions are met for conducting the pressure-based working capacity diagnostic (yes or no), over time. Timeline 600 further includes plot 620, indicating CVV status, plot 625, indicating FTIV status, and plot 630, indicating CPV status, over time. For each of plot 620, 625, and 630, the respective valves may be open or closed, over time. Timeline 600 further includes plot 635, indicating pressure in the evaporative emissions system as monitored, for example via FTPT1 (e.g. 282), and plot 640, indicating fuel system pressure as monitored, for example, via FTPT2 (e.g. 291), over time. Timeline 600 further includes plot 645, indicating whether canister degradation is indicated (yes or no), over time.

At time t0, purging of the canister is not requested (plot 605), and conditions are not indicated to be met for conducting purging of the canister (plot 610), or for conducting the pressure-based working capacity diagnostic (plot 615). The CVV is open (plot 620), and the FTIV (plot 625) and the CPV (plot 630) are both closed. Pressure in the evaporative emissions system is near atmospheric pressure (plot 635) as a result of the CVV being open, whereas pressure in the sealed fuel system (plot 640) is positive with respect to atmospheric pressure. At time t0, the canister is not indicated to be degraded (plot 645).

At time t1, purging is requested via the controller of the vehicle. The controller assesses whether conditions are met for conducting a purging operation between time t1 and t2, and at time t2 it is determined that conditions are met for conducting the purging operation (plot 610). Accordingly, purging is initiated via the commanding open of the CPV (plot 630). While not explicitly illustrated, it may be understood that purging of the canister may involve duty cycling the CPV first at an initial, lower rate, and then ramping up the duty cycle over time in order to increase the amount of fuel vapors being inducted into the engine. However, for simplicity in this example timeline the CPV is depicted as opening in order to purge the contents of the canister to engine intake, however a purge ramp may be conducted without departing from the scope of this disclosure.

Between time t2 and t3, fuel vapors are desorbed from the canister and routed to engine intake for combustion. While not explicitly illustrated, it may be understood that during the purging, desired air-fuel ratio is maintained by at least controlling fuel injection amount and/or timing and controlling throttle position, as a function of an inferred amount of fuel vapors being inducted to the engine, the inferred amount based on output from one or more exhaust gas sensor(s) (e.g. 237). The inferred amount of fuel vapor being inducted into the engine may additionally serve as an indication of canister loading state, for example when it is indicated that an appreciable amount of fuel vapors are no longer being inducted to the engine, then it may be inferred that the canister is clean (e.g. loaded to less than 5%). Accordingly, at time t3 it is indicated that conditions are no longer met for purging (plot 610), and thus purging is no longer requested (plot 605). The CPV is commanded closed (plot 630). While not explicitly illustrated, it may be understood that in this example timeline 600, conditions are no longer met for purging at time t3 because the canister is indicated to be clean. Furthermore, at time t3, conditions are indicated to be met for conducting the pressure-based working capacity diagnostic. Conditions for entry into the diagnostic have been discussed in detail above with regard to step 435 of FIG. 4, and thus such conditions will not be reiterated here for brevity.

With the CPV closed (plot 630) and the CVV open (plot 620), pressure in the evaporative emissions system rapidly returns to atmospheric pressure between time t3 and t4 (plot 635). At time t4, the CVV is commanded closed (plot 620), thus sealing the evaporative emissions system from atmosphere. The FTIV is maintained closed, and the CPV is also maintained closed, thus at time t4 the evaporative emissions system is sealed from engine intake, the fuel system, and from atmosphere.

As discussed above with regard to FIG. 4, a pressure build threshold 636 is set as a function of an expected pressure build based on the purging event. The expected pressure build may be based on an assumption that the working capacity of the canister is not degraded to any appreciable extent, and may be a function of inferred canister loading state prior to the purging event and after completion of the purging event. The pressure build threshold may further be set as a function of ambient temperature, wind, vehicle speed, engine heat rejection, etc. Specifically, the pressure build threshold may be increased (e.g. made more positive) as ambient temperature increases, decreased as wind speed increased, decreased as vehicle speed increases, and increased as engine heat rejection increases. Lookup tables stored at the controller may be relied upon for such adjusting of the pressure build threshold.

With the pressure build threshold set and the evaporative emissions system sealed post-purging operation at time t4, between time t4 and t5 pressure in the evaporative emissions system is monitored (plot 635). It may be understood that the pressure build may be monitored for a predetermined duration. In this example timeline 600 it may be understood that the predetermined duration comprises the time period between time t4 and t5. Pressure in the evaporative emissions system does not reach or exceed the pressure build threshold between time t4 and t5, thus canister degradation is indicated at time t5 (plot 645). As discussed above, in some examples a more precise indication of how degraded the working capacity of the canister is, based on the relationship between the pressure build threshold and the pressure build as monitored in the evaporative emissions system.

Furthermore, while not explicitly shown, the timeline of FIG. 5 depicts the vacuum-based working capacity diagnostic while the timeline of FIG. 6 depicts the pressure-based working capacity diagnostic. As an example, in a situation where the pressure-based diagnostic of FIG. 6 comprises a rationality check for the vacuum-based diagnostic of FIG. 5, the results of the two tests may be indicated to be correlated, or in other words, the results of the two tests are in agreement with each other. Thus, it may be determined with high confidence that the working In this way, a working capacity of a fuel vapor canister positioned in an evaporative emissions system of a vehicle may be inferred without the inclusion of one or more temperature sensor(s) within the canister. By providing systems and methods for inferring working capacity of the canister without having to rely on temperature sensor(s), issues related to temperature sensor malfunction, liquid contamination of such temperature sensor(s), and potential sources of undesired evaporative emissions stemming from the canister where the temperature sensor(s) are installed, may be reduced or avoided.

The technical effect is to recognize that based on an amount of fuel added to a fuel tank during a refueling event, along with a number of other relevant variables related to fuel vaporization effects during refueling, a vacuum build threshold may be inferred where, if reached in a sealed evaporative emissions system subsequent to the refueling event, it may be indicated that the working capacity of the canister has not become degraded to any appreciable extent. Alternatively, another technical effect is to recognize that, in a circumstance where the vacuum build threshold is not reached, the extent of the vacuum build in relation to the vacuum build threshold may be relied upon as an indication of an extent to which the fuel vapor canister working capacity has become degraded.

A related technical effect is to recognize that, based on an extent to which a canister is purged of fuel vapors during a purging operation, along with other relevant variables, a pressure build threshold may be set where, if reached in a sealed evaporative emissions system subsequent to the purging operation, it may be indicated that the working capacity of the canister has not become degraded to any appreciable extent. Alternatively, in a circumstance where the pressure build threshold is not reached, the extent of the pressure build in relation to the pressure build threshold may be relied upon as an indication of an extent to which the fuel vapor canister working capacity has become degraded.

A further technical effect is to recognize that the pressure-based working capacity diagnostic may be utilized as a rationality check for the vacuum-based working capacity diagnostic (or vice versa). For example, the vacuum-based working capacity diagnostic may be conducted after completion of a refueling event, and the results may be stored at the controller. Then, the pressure-based working capacity diagnostic may be conducted at the first opportunity where conditions are met for doing so, and if the results are in agreement, then there may be high confidence in the results. Alternatively, if the results are not in agreement, follow-up tests may be scheduled, which may improve customer satisfaction by avoiding false results and thereby avoiding unnecessary trips to have the vehicle serviced.

The systems discussed herein and with regard to FIGS. 1-2, along with the methods described herein and with regard to FIGS. 3-4, may enable one or more systems and one or more methods. In one example, a method comprises in response to fuel vapors being adsorbed by, or desorbed from, a fuel vapor canister positioned in an evaporative emissions system of a vehicle, the fuel vapor canister capturing/storing fuel tank fuel vapors, sealing the evaporative emissions system and indicating degradation of the fuel vapor canister in response to a monitored pressure change in the evaporative emissions system less than a threshold pressure change. In a first example of the method, the method further includes wherein adsorption of fuel vapors by the fuel vapor canister generates heat at the fuel vapor canister; and wherein desorption of fuel vapors by the fuel vapor canister results in a cooling of the fuel vapor canister. A second example of the method optionally includes the first example, and further includes wherein sealing the evaporative emissions system includes sealing the evaporative emissions system from an engine of the vehicle, the fuel tank, and from atmosphere. A third example of the method optionally includes any one or more or each of the first and second examples, and further includes wherein fuel vapors being adsorbed to the fuel vapor canister further comprises a refueling event that loads the fuel vapor canister with fuel vapors. A fourth example of the method optionally includes any one or more or each of the first through third examples, and further includes wherein fuel vapors being desorbed from the fuel vapor canister comprises a purging operation of the fuel vapor canister. A fifth example of the method optionally includes any one or more or each of the first through fourth examples, and further includes wherein the threshold pressure change comprises a positive threshold pressure change with respect to atmospheric pressure in response to fuel vapors being desorbed from the fuel vapor canister. A sixth example of the method optionally includes any one or more or each of the first through fifth examples, and further includes wherein the threshold pressure change comprises a negative threshold pressure change with respect to atmospheric pressure in response to fuel vapor being adsorbed to the fuel vapor canister. A seventh example of the method optionally includes any one or more or each of the first through sixth examples, and further includes wherein the threshold pressure change is set by a controller of the vehicle as a function of an amount of fuel vapors adsorbed by, or desorbed from, the fuel vapor canister. An eighth example of the method optionally includes any one or more or each of the first through seventh examples, and further includes wherein the threshold pressure change is adjusted to compensate for one or more of ambient temperature, wind, heat generation related to vehicle componentry in proximity to the fuel vapor canister, and a speed of the vehicle. A ninth example of the method optionally includes any one or more or each of the first through eighth examples, and further comprises indicating an extent of fuel vapor canister degradation based on a relationship between the monitored pressure change and the threshold pressure change. A tenth example of the method optionally includes any one or more or each of the first through ninth examples, and further includes wherein the fuel vapor canister does not include one or more temperature sensor(s) or other means of directly measuring temperature of the fuel vapor canister.

Another example of a method comprises in response to a refueling event where a fuel tank of a vehicle is filled by at least a threshold amount, inferring a heat gain by a fuel vapor canister positioned in an evaporative emissions system of the vehicle as a function of the refueling event, where the fuel vapor canister captures and stores fuel vapors from a fuel tank of the vehicle during the refueling event; setting a vacuum-build threshold based on the inferred heat gain; sealing the evaporative emissions system from the fuel tank, from an engine of the vehicle, and from atmosphere; and indicating an absence of degradation of the fuel vapor canister in response to a monitored pressure in the sealed evaporative emissions system reaching or exceeding the vacuum-build threshold. In a first example of the method, the method further includes wherein the threshold amount comprises at least fifty percent of a capacity of the fuel tank. A second example of the method optionally includes the first example, and further includes wherein inferring the heat gain includes an assumption that the fuel vapor canister is not degraded to any measurable extent. A third example of the method optionally includes any one or more or each of the first and second examples, and further includes wherein inferring the heat gain is based on an amount of fuel added to the fuel tank during the refueling event, and is further a function of one or more parameters related to fuel vaporization. A fourth example of the method optionally includes any one or more or each of the first through third examples, and further includes wherein the vacuum-build threshold is further a function of one or more of ambient temperature, an amount of heat rejection from the engine, a speed of the vehicle, and one or more other environmental parameters.

An example of a system for a vehicle comprises a fuel vapor canister positioned in an evaporative emissions system of the vehicle, the evaporative emissions system selectively fluidically coupled to an engine via a canister purge valve, selectively fluidically coupled to a fuel tank via a fuel tank isolation valve, and selectively fluidically coupled to atmosphere via a canister vent valve; and a controller with computer readable instructions stored on non-transitory memory that, when executed, cause the controller to: estimate a heat gain at the fuel vapor canister resulting from adsorption of fuel vapors by the fuel vapor canister during a refueling event of the fuel tank; set a vacuum build threshold as a function of the heat gain estimated from the refueling event; seal the evaporative emissions system from the engine, from the fuel tank, and from atmosphere by commanding closed the canister purge valve, the fuel tank isolation valve, and the canister vent valve; monitor a vacuum build in the sealed evaporative emissions system for a predetermined duration; and indicate degradation of the fuel vapor canister in response to the vacuum build not reaching or exceeding the vacuum build threshold, and indicating that the fuel vapor canister is not degraded in response to the vacuum build reaching or exceeding the vacuum build threshold. In a first example of the system, the system further comprises a fuel level indicator positioned in the fuel tank for monitoring fuel level; and wherein the controller stores further instructions to estimate the heat gain at the fuel vapor canister based on an amount of fuel added to the fuel tank during the refueling event. A second example of the system optionally includes the first example, and further comprises an ambient temperature sensor; and wherein the controller stores further instructions to adjust the vacuum build threshold as a function of ambient temperature. A third example of the system optionally includes any one or more or each of the first through second examples, and further includes wherein the fuel vapor canister does not contain means for directly monitoring the heat gain at the canister.

In another representation, a method comprises inferring an amount of fuel vapors added to a fuel vapor canister positioned in an evaporative emissions system during a refueling event of a fuel tank, extrapolating a heat gain at the fuel vapor canister based on the inferred amount of fuel vapors added to the fuel vapor canister, and after refueling of the fuel tank has stopped, sealing the fuel vapor canister from atmosphere, from a fuel tank and from an engine and monitoring a vacuum build in the sealed evaporative emissions system. In response to the vacuum build not reaching a vacuum build threshold, the vacuum build threshold set as a function of the extrapolated heat gain, the method comprises setting a flag at a controller indicating potential fuel vapor canister degradation, and further comprises scheduling a rationalization test. The rationalization test comprises a pressure-based diagnostic following a purging operation of the fuel vapor canister. In such a method, an amount whereby the fuel vapor canister is cooled is inferred as a function of an amount of fuel vapors desorbed from the fuel vapor canister during the purging event, and a pressure build threshold is set as a function of the inferred amount of canister cooling. The pressure-based diagnostic is conducted via sealing the evaporative emissions system from atmosphere, from engine intake, and from the fuel tank, and a pressure build is monitored. In response to the pressure build not reaching the pressure build threshold, the method comprises confirming fuel vapor canister degradation. Alternatively, in a case where the pressure build reaches the pressure build threshold, but where the vacuum build did not reach the vacuum build threshold, results of the test are discarded and further tests are scheduled to assess working capacity of the canister. Similarly, in case where the pressure build does not reach the pressure build threshold, but where the vacuum build reaches the vacuum build threshold, the results are discarded and follow-up tests are scheduled. In another example where the vacuum build reaches the vacuum build threshold, and the pressure build reaches the pressure build threshold, an absence of canister degradation is indicated.

In some examples of the method, in a case where the vacuum build does not reach the vacuum build threshold and where the pressure build additionally does not reach the pressure build threshold, an extent to which the fuel vapor canister is degraded is indicated based on the vacuum build as compared to the vacuum build threshold, and the pressure build as compared to the pressure build threshold. Specifically, a first extent of degradation is indicated based on the vacuum build as compared to the vacuum build threshold, and a second extent of degradation is indicated based on the pressure build as compared to the pressure build threshold. The first extent of degradation and the second extent of degradation are averaged to provide a current working capacity, or said another way, a current level of canister degradation.

In some examples of the method, the diagnostic involving the pressure build is utilized as a rationality test for the diagnostic involving the vacuum build, whereas in other examples of the method, the diagnostic involving the vacuum build is utilized as a rationality test for the diagnostic involving the pressure build.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

in response to fuel vapors being adsorbed to a fuel vapor canister follow a refueling event that loads a fuel vapor canister positioned in an evaporative emissions system of a vehicle with fuel vapors to a first initial value, sealing the evaporative emissions system and determining a fuel vapor canister adsorption capacity in response to a monitored vacuum change in the evaporative emissions system and based on the first initial value, and in response to fuel vapors being desorbed to the fuel vapor canister follow a purging event that unloads the fuel vapor canister to a second initial, sealing the evaporative emissions system and determining a fuel vapor canister desorption capacity in response to a monitored pressure build in the evaporative emissions system and based on the second initial value; and indicating degradation based on the determined adsorption and desorption capacities.

2. The method of claim 1, wherein adsorption of fuel vapors by the fuel vapor canister generates heat at the fuel vapor canister; and wherein desorption of fuel vapors by the fuel vapor canister results in a cooling of the fuel vapor canister.

3. The method of claim 1, wherein sealing the evaporative emissions system includes sealing the evaporative emissions system from an engine of the vehicle, the fuel tank, and from atmosphere and wherein conditions required for carrying out the determining of capacities include an indication that the evaporative emissions system is free from any sources of undesired evaporative emissions.

4. The method of claim 1, wherein fuel vapors being adsorbed to the fuel vapor canister further comprises a refueling event that loads the fuel vapor canister with fuel vapors, and wherein fuel vapors being desorbed from the fuel vapor canister comprises a purging operation of the fuel vapor canister.

5. The method of claim 1, wherein a threshold pressure change indicates proper canister function, and the threshold pressure change comprises a positive threshold pressure change with respect to atmospheric pressure in response to fuel vapors being desorbed from the fuel vapor canister.

6. The method of claim 1, wherein a threshold pressure change indicates proper canister function, and the threshold pressure change comprises a negative threshold pressure change with respect to atmospheric pressure in response to fuel vapor being adsorbed to the fuel vapor canister.

7. The method of claim 6, wherein the threshold pressure change is set by a controller of the vehicle as a function of an amount of fuel vapors adsorbed by, or desorbed from, the fuel vapor canister.

8. The method of claim 6, wherein the threshold pressure change is adjusted to compensate for one or more of ambient temperature, wind, heat generation related to vehicle componentry in proximity to the fuel vapor canister, and a speed of the vehicle.

9. The method of claim 1, further comprising indicating an extent of fuel vapor canister working capacity degradation based on a relationship between the monitored pressure change and a threshold pressure change.

10. The method of claim 1, wherein the fuel vapor canister does not include one or more temperature sensor(s) or other means of directly measuring temperature of the fuel vapor canister.

11. The method of claim 1, wherein the capacities are determined without relying on one or more temperature sensor(s) embedded in the canister.

12. The method of claim 1, wherein the determined capacities are determined without any significant amount of fuel vapors flowing through the canister and out to atmosphere via a vent line.

* * * * *